US010149088B2

(12) United States Patent
Patil et al.

(10) Patent No.: US 10,149,088 B2
(45) Date of Patent: Dec. 4, 2018

(54) SPEAKER POSITION IDENTIFICATION WITH RESPECT TO A USER BASED ON TIMING INFORMATION FOR ENHANCED SOUND ADJUSTMENT

(71) Applicant: SONY CORPORATION, Tokyo (JP)

(72) Inventors: Sharanappagouda Patil, Bangalore (IN); Fujishita Kaneaki, Bangalore (IN)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/813,525

(22) Filed: Nov. 15, 2017

(65) Prior Publication Data

US 2018/0242095 A1 Aug. 23, 2018

Related U.S. Application Data

(60) Provisional application No. 62/461,458, filed on Feb. 21, 2017.

(51) Int. Cl.

| | |
|---|---|
| ***H04S 7/00*** | (2006.01) |
| ***H04S 3/00*** | (2006.01) |
| ***H04R 5/02*** | (2006.01) |

(52) U.S. Cl.

CPC ..... *H04S 7/301* (2013.01); *H04R 5/02* (2013.01); *H04S 3/008* (2013.01); *H04S 2400/01* (2013.01); *H04S 2400/15* (2013.01)

(58) Field of Classification Search

None

See application file for complete search history.

(56) References Cited

U.S. PATENT DOCUMENTS

| | | | | |
|---|---|---|---|---|
| 9,363,597 | B1 | 6/2016 | Kulavik et al. | |
| 2013/0329921 | A1* | 12/2013 | Salsman | H04S 7/303 381/303 |
| 2015/0264506 | A1 | 9/2015 | Balabanis et al. | |
| 2015/0350804 | A1* | 12/2015 | Crockett | H04R 5/02 381/307 |
| 2017/0134858 | A1* | 5/2017 | Kanemori | H04R 3/14 |
| 2017/0245087 | A1* | 8/2017 | Baba | H04R 5/02 |

FOREIGN PATENT DOCUMENTS

JP 2006050363 A * 2/2006

OTHER PUBLICATIONS

Machine Translation of Eto et al. (JP 2006050363 A), published Feb. 2006, with original Japanese Patent attached.*

* cited by examiner

*Primary Examiner* — Peter Vincent Agustin
(74) *Attorney, Agent, or Firm* — Chip Law Group

(57) ABSTRACT

Various aspects of a system and method for speaker position identification with respect to a user based on timing information for enhanced sound adjustment in a multi-channel speaker system are disclosed herein. The system includes an electronic device that receives a first timing signal from a control device of the speaker system. The first timing signal indicates a first time instant at which an audio signal is communicated, by the control device, to a first speaker of a plurality of speakers of the speaker system. An output of the audio signal is recorded from the first speaker at a second time instant by the electronic device. An absolute distance between the first speaker and the electronic device associated with a user, is determined based on the first and second time instant. A first instruction to calibrate at least the first speaker is generated based on the determined absolute distance.

21 Claims, 10 Drawing Sheets

SPEAKER POSITION IDENTIFICATION WITH RESPECT TO A USER BASED ON TIMING INFORMATION FOR ENHANCED SOUND ADJUSTMENT

CROSS-REFERENCE TO RELATED APPLICATIONS/INCORPORATION BY REFERENCE

This application claims priority to U.S. Provisional Patent Application Ser. No. 62/461,458 filed on Feb. 21, 2017, the entire content of which is hereby incorporated herein by reference.

FIELD

Various embodiments of the disclosure relate to multi-channel speaker systems technologies. More specifically, various embodiments of the disclosure relate to a system and method for speaker position identification with respect to a user based on timing information for enhanced sound adjustment in multi-channel speaker systems.

BACKGROUND

With advancements in multi-channel audio technologies, various configurations of speaker systems have become popular in recent years. Currently, speaker systems are provided in various manufacturer specified configurations, such as a 2.1, a 5.1, or a 7.1 speaker configuration, or as separate portable speaker devices, which can be configured as desired. The speaker systems allow for the reproduction of sound in a listening area. Currently, sound reproduction and adjustment techniques in a listening area, such as a room, for multi-channel speaker systems is an active area of research and development to enhance listening experience. Typically, an ideal listener position, referred to as a sweet-spot, is at the center of the speaker systems setup. In certain scenarios, when the position of a listener changes or the listener is near a certain speaker as compared to other speakers, then the sound from all speakers reaching the listener may not be same. In such a scenario, the listener will hear more sound output from the nearest speaker that may in turn limit the overall surround sound listening experience of the listener. Consequently, an advanced system may be required capable of sound adjustments based on a current position of a listener from a speaker in a multi-channel speaker system setup with a high precision.

Further limitations and disadvantages of conventional and traditional approaches will become apparent to one of skill in the art, via comparison of described systems with some aspects of the present disclosure, as set forth in the remainder of the present application and with reference to the drawings.

SUMMARY

A system and method for speaker position identification with respect to a user based on timing information for enhanced sound adjustment in a multi-channel speaker system is provided substantially as shown in, and/or described in connection with, at least one of the figures, as set forth more completely in the claims.

These and other features and advantages of the present disclosure may be appreciated from a review of the following detailed description of the present disclosure, along with the accompanying figures in which like reference numerals refer to like parts throughout.

DETAILED DESCRIPTION

Figure 1:
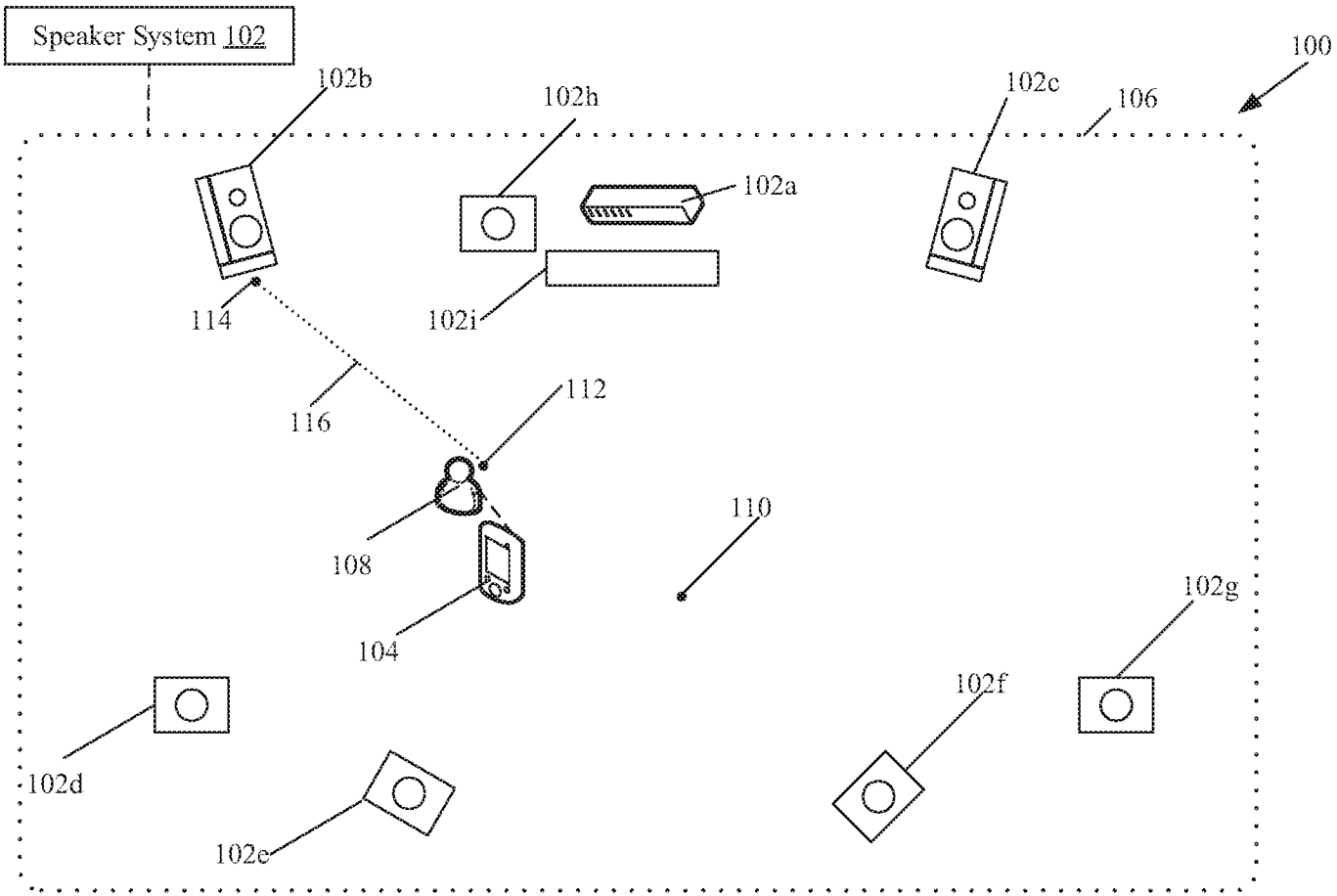
FIG. 1 illustrates an exemplary environment of a speaker system, in accordance with an embodiment of the disclosure.

The following described implementations may be found in the disclosed embodiments of a speaker system, an electronic device, and methods for the speaker system for speaker position identification with respect to a user based on timing information for enhanced sound adjustment. Exemplary aspects of the disclosure may include the speaker system that may include a plurality of speakers and at least one processor. The processor may be communicatively coupled to the plurality of speakers of the speaker system and an electronic device of a user. The processor may be configured to communicate an audio signal to a first speaker of the plurality of speakers and a first timing signal to the electronic device at a first time instant. The first timing signal may indicate the first time instant at which the audio signal is communicated to the first speaker. Further, the processor may receive a second timing signal from the electronic device. The second timing signal may be indicative of a second time instant at which an output of the audio signal from the first speaker may be recorded by the electronic device at a first location of the electronic device. In addition, the processor may be configured to determine a first absolute distance between the first speaker and the electronic device, based on the first timing signal and the second timing signal. In accordance with an embodiment, determination of the first absolute distance may be based on a difference of the second time instant provided in the second timing signal, and the first time instant provided in the first timing signal. Thereafter, the processor may calibrate at least the first speaker for reproduction of audio based on the determined first absolute distance.

In accordance with an embodiment, the first timing signal and/or the second timing signal may be generated using at least one of a Global Positioning System (GPS)-based circuit, a radio frequency-based circuit, and/or a timer circuit provided in said speaker system. The processor may be further configured to determine a second absolute distance between a second speaker of the plurality of speakers and the electronic device at the first location of the electronic device. An output of the audio signal from the second speaker may be recorded by the electronic device at the first location. In addition, the processor may be configured to determine a third absolute distance from the first speaker and a fourth absolute distance from the second speaker, to the electronic device. The third absolute distance and the fourth absolute distance may be determined from a second location of the electronic device at which the output of the audio signal from the first speaker and the second speaker may be recorded by the electronic device. In accordance with an embodiment, the first location and the second location of the electronic device may lie in a first plane that may be parallel to a second plane. The first speaker and the second speaker may lie in the second plane.

In accordance with an embodiment, the processor may be further configured to determine a first orientation of the first speaker with respect to the electronic device. The first orientation may be determined based on a distance between the first location and the second location of the electronic device, and the first absolute distance of the first speaker from the electronic device. In addition, the processor may further calibrate at least the first speaker for the reproduction of the audio in a direction of the first orientation. In some embodiments, the plurality of speakers may be concurrently calibrated based on the determined absolute distances between each of the plurality of speakers with respect to the electronic device held by the user.

In accordance with an embodiment, the processor may be configured to re-calibrate the plurality of speakers for reproduction of the audio based on a current listening position of the user associated with the electronic device. The processor may shift an acoustic sweet-spot of the speaker system from a first listening position to a second listening position based on calibration of the plurality of speakers for reproduction of one or more audio segments. In accordance with an embodiment, the first listening position may correspond to a location at which the audio output of the plurality of speakers may be initially focused (an ideal manufacturer specified sweet-spot). Further, the second listening position (re-calibrated or auto-calibrated sweet-spot) may correspond to the current location of the electronic device associated with the user.

In accordance with an exemplary aspect of the disclosure, the electronic device may include at least one processor to implement a method for the speaker system. The method may include receipt of a first timing signal from a control device, for example, a central unit, of the speaker system. The first timing signal may indicate the first time instant at which the audio signal may be communicated, by the control device, to the first speaker. Thereafter, the output of the audio signal may be recorded from the first speaker at a second time instant, at a first position of the electronic device associated with the user. Further, an absolute distance between the first speaker and the electronic device may be determined, based on the first and second time instants. Thereafter, a first instruction to calibrate at least the first speaker may be generated, based on the determined absolute distance, and then communicated to the control device for the calibration of the first speaker. In addition, in accordance with an embodiment, a second instruction to shift the acoustic sweet-spot of the speaker system may be communicated to the control device. The acoustic sweet-spot of the speaker system may be shifted from a first listening position to a second listening position, based on calibration of the plurality of speakers for reproduction of one or more audio segments. The processor may be configured to determine a first orientation of the first speaker with respect to the electronic device, based on a distance between two different locations of the electronic device, and the absolute distance of the first speaker from the electronic device.

In accordance with an exemplary aspect of the disclosure, an electronic device for a speaker system may include a processor configured to communicate a calibration start signal to a control device that is a communicatively coupled to a plurality of speakers of the speaker system. The calibration start signal may be communicated to the control device at a first time instant. The electronic device may store an indication of the first time instant in a memory of the electronic device. Thereafter, a timing signal may be received from the control device of the speaker system based on the communicated calibration start signal. The timing signal may indicate a second time instant at which an audio signal is communicated, by the control device, to the plurality of speakers of the speaker system. Thereafter, an output of a plurality of audio samples included in the audio signal are recorded from the plurality of speakers at a plurality of different time instants. Further, a plurality of absolute distances between each of the plurality of speakers and the electronic device associated with a user is determined. The determination of the plurality of absolute distances may be based on the second time instant and the plurality of time instants. Further, a first instruction may be generated for calibration of the plurality of speakers, based on the determined plurality of absolute distances.

FIG. 1 illustrates an exemplary environment of a speaker system, in accordance with an embodiment of the disclosure. With reference to FIG. 1, there is shown an exemplary environment 100. The exemplary environment 100 may include a speaker system 102, an electronic device 104, and a listening area 106. A user 108 may be associated with the electronic device 104. The speaker system 102 may include a control device 102*a* and a plurality of speakers 102*b* to 102*i*. The exemplary environment 100 further depicts a first listening position 110, a second listening position 112, a speaker location 114 of a first speaker 102*b* of the plurality of speakers 102*b* to 102*i*, and a first distance 116 between the speaker location 114 of the first speaker 102*b* and the second listening position 112.

The speaker system 102 may refer to a multi-channel speaker system, a home theatre system, or an audio video (AV) entertainment system, or other home entertainment system. The speaker system 102 may include the control device 102*a* and the plurality of speakers 102*b* to 102*i*.

The control device 102*a* refers to an audio video receiver (AVR) of the speaker system 102. The control device 102*a* may be a component of the speaker system 102, such as a home theater, configured to receive audio and video signals from a plurality of sources, process the received audio and video signals, and finally communicate the processed audio/video signals to various speakers, such as the plurality of speakers 102*b* to 102*i* for audio output. The received audio and video signals may also be referred to as multimedia AV content. Examples of the plurality of sources of the receipt of the audio and video signals may include, but are not limited to television broadcast services, online/Internet-based broadcast services, podcasts, one or more media storage devices, or cloud-based streaming or storage services. In some embodiments, the control device 102*a* may be communicatively coupled to a display device (not shown). In such embodiments, the control device 102*a* may be configured to communicate video segments of the AV content to the display device for display. In some embodiments, the control device 102*a* (such as the AVR) may include integrated speakers. In such embodiments, audio segments may be output via a combination of the integrated speakers and the plurality of speakers 102*b* to 102*i* external to the control device 102*a*. In accordance with an embodiment, the control device 102*a* may be further configured to synchronize the output of audio streams of AV content on the plurality of speakers 102*b* to 102*i* with playback of corresponding video segments on the display device. The control device 102*a* may comprise suitable logic, circuitry, interfaces, and/or code that may be configured to control audio reproduction by the speaker system 102. The control device 102*a* may be communicatively coupled to the plurality of speakers 102*b* to 102*i* of the speaker system 102, via a wired or a wireless network. The control device 102*a* may also be communicatively coupled to the electronic device 104, via a wireless network.

Each of the plurality of speakers 102*b* to 102*i* of the speaker system 102, may comprise suitable logic, circuitry, interfaces, and/or code that may be configured to output audio. Each of the plurality of speakers 102*b* to 102*i* may be positioned in a particular location in the listening area 106 to create a surround-sound listening environment. The locations of each of the plurality of speakers 102*b* to 102*i* may be known to the control device 102*a*. The plurality of speakers 102*b* to 102*i* may be configured to reproduce multi-channel audio based on determined locations and/or configurations of the speakers 102*b* and 102*i* within the listening area 106. For example, the speaker 102*i* may correspond to a central speaker, while the speakers 102*b* to 102*g* may correspond to one or more surround speakers. The plurality of speakers 102*b* to 102*i* may be positioned within the listening area 106 to create a sweet-spot, such as the first listening position 110. The first speaker (e.g., the speaker 102*b*) may lie on a front-left side of the user 108, while the speaker 102*e* may lie on a rear left side of the user 108, when the user 108 faces towards the control device 102*a*. Further, the speaker 102*h* may correspond to a sub-woofer speaker to reproduce low-bass frequency audio output.

A person with ordinary skill in the art may understand that the control device 102*a* may be implemented as an integrated circuit in the AVR, a separate device, or integrated with one of the of plurality of speakers 102*b* to 102*i* of the speaker system 102.

The electronic device 104 may comprise suitable logic, circuitry, interfaces, and/or code to receive the first timing signal from the control device 102*a*. The first timing signal may include a first time instant at which audio signal is communicated by the control device 102*a* to the first speaker (e.g., the speaker 102*b*). The electronic device 104 may record an output of the audio signal from the first speaker (e.g., the speaker 102*b*) at a second time instant. Further, the electronic device 104 may determine the first absolute distance (e.g., the first distance 116) between the first speaker (e.g., the speaker 102*b*) and the electronic device 104 associated with the user 108. The electronic device 104 may be configured to generate a first instruction to calibrate at least the first speaker (e.g., the speaker 102*b*), based on the determined first absolute distance. The electronic device 104 may be configured to communicate the generated first instruction to the control device 102*a* for the calibration of at least the first speaker (e.g., the speaker 102*b*) based on the current position of the electronic device 104 or user 108, such as the second listening position 112, for reproduction of audio. Examples of the electronic device 104 includes, but are not limited to, a smartphone, a laptop, a tablet computing device, a wearable computing device, or any other portable computing device.

The listening area 106 refers to a room or an area in which the speaker system 102 is placed for audio/video (AV) consumption by a user, such as the user 108. In some embodiments, the listening area 106 may correspond to a region in an indoor or an outdoor environment in which the speaker system 102 may be installed. One or more users (such as the user 108) within the listening area 106 may hear the audio output by the plurality of speakers 102*b* to 102*i* of the speaker system 102.

The user 108 may correspond to an individual who holds the electronic device 104 and operates the electronic device 104. The user 108 may be located within the listening area 106 to consume (i.e. view/hear) multimedia AV content that may be reproduced via the display device communicatively coupled to the control device 102*a* and/or the plurality of speakers 102*b* to 102*i* of the speaker system 102. The user 108 may also operate the speaker system 102 by use of the control device 102*a* or a remote control unit (not shown).

The first listening position 110, corresponds to a predefined or manufacturer specified sweet-spot of the speaker system 102. The second listening position 112 corresponds to a current location of the user 108 who holds the electronic device 104. As the user 108 holds the electronic device 104, a location of the electronic device 104 may be same as of the location of the user 108. The first distance 116 may correspond to the first absolute distance between the first speaker (e.g., the speaker 102*b*) and the electronic device 104.

In operation, the control device 102*a* may be configured to communicate audio signals to the plurality of speakers 102*b* to 102*i* for reproduction of audio. For example, the control device 102*a* may communicate an audio signal to a first speaker (e.g., the speaker 102*b*) of the plurality of speakers 102*b* to 102*i* at a first time instant. Further, the control device 102*a* may be configured to communicate a first timing signal that indicates the first time instant to the electronic device 104.

In accordance with an embodiment, the control device 102*a* may be configured to receive a second timing signal that indicates a second time instant, from the electronic device 104. The second time instant may correspond to a time at which the electronic device 104 may record an output of audio associated with the audio signal from the first speaker (e.g., the speaker 102*b*) at the second listening position 112 in the listening area 106. The control device 102*a* may be configured to determine a first absolute distance (e.g., the first distance 116) between the first speaker (e.g., the speaker 102*b*) of the plurality of speakers 102*b* to 102*i* and the electronic device 104 associated with the user 108. The first absolute distance (e.g., the first distance 116) may be determined based on the first timing signal and the second timing signal. In accordance with an embodiment, the determination of the first absolute distance (e.g., the first distance 116) may be based on a difference between the second time instant and the first time instant. Further, the control device 102*a* may be configured to calibrate the first speaker (e.g., the speaker 102*b*) for reproduction of the audio based on the determined first absolute distance between the first speaker (e.g., the speaker 102*b*) and electronic device 104.

In accordance with an embodiment, the control device 102*a* may be further configured to determine a first orientation of the first speaker (e.g., the speaker 102*b*) with respect to the electronic device 104, based on distance between two different locations of the electronic device 104 and the first absolute distance (e.g., the first distance 116). Further, the control device 102*a* may be configured to calibrate at least the first speaker (e.g., the speaker 102*b*) for the reproduction of the audio in a direction of the first orientation. The determination of the first absolute distance and the first orientation have been explained further, for example, in FIG. 6.

In accordance with an embodiment, the control device 102*a* may be further configured to re-calibrate the plurality of speakers 102*b* to 102*i* of the speaker system 102 for reproduction of the audio. The re-calibration of the plurality of speakers 102*b* to 102*i* may be based on a current listening position (e.g., the second listening position 112) of the user 108 associated with the electronic device 104. The control device 102*a* may be configured to shift an acoustic sweet-spot of the speaker system 102 from the first listening position 110, to the second listening position 112 within the listening area 106. The acoustic sweet-spot of the speaker system 102 may be shifted based on calibration of the plurality of speakers 102*b* to 102*i* for reproduction of the one or more audio segments. The acoustic sweet-spot may correspond to a location, within the listening area 106, at which the audio output of the plurality of speakers 102*b* to 102*i* may be focused or directed towards. For example, based on preconfigured settings of the plurality of speakers 102*b* to 102*i*, the first listening position 110, may correspond to an initial acoustic sweet-spot of the speaker system 102. From the perspective of a listener, such as the user 108, the acoustic sweet-spot may correspond a focal point (such as a particular location) between two or more speakers, such as the plurality of speakers 102*b* to 102*i*, where the listener is capable of hearing an audio mix in most optimized manner, i.e. the way intended to be heard. Further, after the control device 102*a* calibrates the plurality of speakers 102*b* to 102*i* based on the current location of the user 108, the audio output of the plurality of speakers 102*b* to 102*i* may focus towards the second listening position 112, which may now correspond to the new acoustic sweet-spot of the speaker system 102. The calibration of the plurality of speakers 102*b* to 102*i* and the shifting of the acoustic sweet-spot of the speaker system 102 has been explained further, for example, in FIGS. 7A and 7B.

In accordance with an exemplary aspect of the disclosure, the first absolute distance (e.g., the first distance 116) may be determined by the electronic device 104 instead of the control device 102*a*. In such cases, the electronic device 104 may be configured to receive the first timing signal from the control device 102*a*. Thereafter, the electronic device 104, located at the second listening position 112, may record the output of audio from the first speaker (e.g., the speaker 102*b*) at the second time instant. The electronic device 104 may be configured to determine the first absolute distance (e.g., the first distance 116) based on a difference between the second time instant and the first time instant. Further, the electronic device 104 may be configured to generate a first instruction for calibration of the first speaker (e.g., the speaker 102*b*) for reproduction of the audio based on the determined absolute distance. Thereafter, the electronic device 104 may be configured to communicate the generated first instruction to the control device 102*a*.

The electronic device 104 may be configured to determine the first orientation of the first speaker (e.g., the speaker 102*b*) of the plurality of speakers 102*b* to 102*i* with respect to the electronic device 104. The first orientation may be determined based on a distance between two different locations of the electronic device 104, and the first absolute distance (e.g., the first distance 116) of the first speaker (e.g., the speaker 102*b*) from the electronic device 104. The generation of the first instruction may be further based on the determined first orientation of the first speaker (e.g., the speaker 102*b*) with respect to the electronic device 104.

The electronic device 104 may be further configured to generate and communicate a second instruction to the control device 102*a* to shift the acoustic sweet spot of the speaker system 102 from the first listening position 110, to the second listening position 112, based on calibration of the plurality of speakers 102*b* to 102*i* of the speaker system 102 for reproduction of the one or more audio segments.

In accordance with an exemplary aspect of the disclosure, the calibration of the plurality of speakers 102*b* to 102*i* may be initiated by the user 108 (i.e. user initiation for acoustic sweet spot adjustment). The user 108 may initiate the calibration process to shift the acoustic sweet spot of the speaker system 102 to change the acoustic sweet spot suited for the current position of the user 108 for enhanced surround sound experience. For example, an application installed in the electronic device 104, may be used to initiate the auto-calibration process of the plurality of speakers 102*b* to 102*i* of the speaker system 102. The user 108 of the electronic device 104 may provide an input via user interface (UI) or application interface to initiate the auto-calibration process of the plurality of speakers 102*b* to 102*i*. The user 108 may press or touch a "initiate calibration" UI element rendered on the electronic device 104 held by the user 108. When the user 108 initiates the auto-calibration process, and on reception of the user-input, the then GPS timing may be noted and the recording is started at the electronic device 104 (e.g. a mobile device). The recorded GPS timing may be referred to as a first time instant. The GPS timing may be retrieved from an inbuilt GPS module of the electronic device 104. Concurrently, at this first time instant, the electronic device 104 may generate a calibration start signal, which is communicated by the electronic device 104 to the control device 102*a* that is communicatively coupled to the plurality of speakers 102*b* to 102*i* of the speaker system 102. The time instant at which the calibration start signal is communicated to the control device 102*a* may be correspond to the first time instant (i.e. t1") that is stored in the electronic device 104.

When the control device 102*a* (e.g. the AVR) receives the calibration start signal from the electronic device 104, the control device 102*a* (e.g. the AVR) may be configured to note the GPS timing information and communicate known number of test audio samples, for example "X" number of audio samples, to all of the plurality of speakers 102*b* to 102*i* of the speaker system 102. The noted GPS timing information may be referred to as a second time instant. At this second time instant (i.e. "t2"), the GPS timing information may be retrieved from an inbuilt GPS module of the control device 102*a*, and temporally stored. Here, "X" number of audio samples may correspond to number of channels in the speaker system 102, such as the plurality of speakers 102*b* to 102*i*. In addition, the control device 102*a* may further communicate a timing signal that includes the second time instant to the electronic device 104. The communication of the timing signal to the electronic device 104 may occur via a personal wireless network, such as Bluetooth, or Wi-Fi. Alternatively stated, the GPS timing information noted at the control device 102*a* (e.g. the AVR) may be communicated to the electronic device 104 via BT/Wi-Fi etc. The electronic device 104 may store the second time instant, "t2", in the memory of the electronic device 104, upon reception of the timing signal from the control device 102*a*. Thereafter, the plurality of test audio samples may be played-back by each of the plurality of speakers 102*b* to 102*i* one by one to output audio, wherein playback is done at a constant delay, referred to as time period "t3". Out of the "X" number of samples, one sample is output by one speaker at a particular time instant.

In accordance with an embodiment, the electronic device 104 (such as the mobile device) may record output of the audio samples from each of the plurality of speakers 102*b* to 102*i* at different time instants, depending on when the audio is output from the respective speakers 102*b* to 102*i*. The electronic device 104 at a first location in the vicinity of the speaker system 102 may store the different time instants, related to the audio output recorded from the respective speakers 102*b* to 102*i*, in the memory of the electronic device 104. Thereafter, the electronic device 104 may determine a plurality of absolute distances between each of the plurality of speakers 102*b* to 102*i*, and the electronic device 104.

For example, the first time instant (i.e. "t1")=absolute time from GPS module that is noted at the electronic device 104 (i.e. the mobile device side) when the user 108 initiates the auto-calibration process, and the recording is started at this time. The second time instant (i.e. "t2")=absolute time from GPS module that is noted at the control device 102*a* (e.g. the AVR side) when the known number of test audio samples is sent to the plurality of speakers 102*b* to 102*i* speakers. The absolute time ("t3") may be a known delay (i.e. the constant delay) and a constant value can be fixed.

First Speaker Distance Calculation:

The sample difference or the sample number "d1" between second time instant (i.e. "t2") and start of the first recorded known signal is to be calculated. The value of sample difference "d1" can be used to calculate the distance of the first speaker (e.g. the speaker 102*b*) to the user 108 (who holds the electronic device 104), as given below:

The first audio sample of the communicated known audio samples to be played from a speaker at time "t2" is considered as $0^{th}$ sample. The start of the playback of the first audio sample is searched from the second time instant (i.e. "t2"). Further, the number of audio samples recorded before the start of the first channel data, if any, may be identified. The value of sample difference "d1" can be used to calculate the absolute distance of the first speaker (e.g. the speaker 102*b*) to the user 108 as given by equation (1) below;

$$td1 = d1/FS \quad (1),$$

where, FS represents sampling frequency.

$$\text{Velocity of sound} \times \text{time } (td1) = \text{distance } (DS1) \quad (2),$$

Where "Velocity of sound" refers to distance travelled per unit time by a sound wave as it propagates through an elastic medium. For example, in dry air at 0° C. (32° F.), the speed of sound is usually 331.2 meters per second. Thus, the determination of the absolute distance between the first speaker (e.g., the speaker 102*b*) and the electronic device 104 may be based on the first time difference (that may be referred to as "td1"). The location of the user 108 may be considered same as the location of the electronic device 104 as the user 108 holds the electronic device 104, such as a smartphone. Thus, using the equation (2), the first absolute distance (such as the distance "DS1" between the electronic device 104 (or the user 108) and the first speaker (e.g., the speaker 102*b*) may be determined and the computed distance "DS1" is the absolute distance.

Second Speaker Distance Calculation:

Similar to the first speaker (e.g. the speaker 102*b*), the actual start time of recording of audio output from a second speaker (e.g., the speaker 102*c*) may be recorded. The sample difference (or sample number) "d2" between time instant (i.e. "t2") and start of the second recorded known signal is to be calculated. The second audio sample of the communicated known audio samples to be played from a second speaker is considered as $1^{st}$ sample. The start of the playback of the second audio sample is searched from the end time instant of recording of the audio output from the first speaker (e.g. the speaker 102*a*). The end time instant of recording of the audio output from the first speaker (e.g. the speaker 102*a*) may be derived based on current number of samples already played (one in this case) and known playback duration of the sample. For example, the audio sample, at time (t2+td1) is start time of recording of the first audio sample for the first speaker (e.g. the speaker 102*a*). From this start time, "X" samples already played may be added to derive end time instant of audio output from the first speaker. The number of samples already recorded may be checked before the start of the second audio sample for second speaker (or channel). This sample number ("d2") value can be utilized to calculate the second distance as below:

$$td2 = d2/FS \quad (3),$$

$$\text{Velocity of sound} \times \text{Time } (td2) = \text{Distance} \quad (4),$$

The second time difference "td2" may take into account the time "t3" that is known delay. Thus, based on second time difference "td2" and using the equation (4), a second absolute distance may be automatically computed between the electronic device 104 (or the user 108) and the second speaker (e.g., the speaker 102*c*). Similarly for other speakers of the speaker system 102, the plurality of absolute distances between each of the plurality of speakers 102*b* to 102*i*, and the electronic device 104, may be determined.

Further, the electronic device 104 may determine an orientation of each of the plurality of speakers 102*b* to 102*i* with respect to the electronic device 104, based on the determined respective absolute distances. To that end, the electronic device 104 may determine the plurality of absolute distances between each of the plurality of speakers 102*b* to 102*i*, at the first location of the user 108 of the electronic device 104. Thereafter, the electronic device 104 may determine a second plurality of absolute distances of the plurality of speakers 102*b* to 102*i* with respect to the electronic device 104, at a second location of the user 108. The determination of the orientation of each speaker may be based on the respective absolute distances of the speaker from the electronic device 104, at the first location and the second location of the user of the electronic device 104. The orientation determination based on angle computation is described, for example, in the FIG. 6.

The electronic device 104 may then be configured to generate an instruction to calibrate each of the plurality of speakers 102*b* to 102*i* based at least on the determined respective absolute distances. The instruction may include one or more calibration parameters, such as, but not limited to, volume settings, phase-settings, equalization settings, channel adjustments, and the like. The electronic device 104 may communicate the generated instruction to the control device 102*a*, which may calibrate the plurality of speakers 102*b* to 102*i* concurrently based on the received instruction. Thus, as the user 108 moves from the first listening position 110, to the second listening position 112, the plurality of absolute distances of the plurality of speakers 102*b* to 102*i* with respect to the electronic device 104, at the second listening position 112 of the user 108, may be re-calculated. The acoustic sweet spot of the speaker system 102 may be shifted from the first listening position 110, to the second listening position 112, based on calibration of the plurality of speakers 102*b* to 102*i* of the speaker system 102 for the second listening position 112 for reproduction of the one or more audio segments suitable for the second listening position 112. From the perspective of a listener, such as the user 108, the acoustic sweet-spot may correspond a focal point (such as a particular location) between multi-channel speaker systems (such as 5.1, 7.1, and the like speaker systems), such as the plurality of speakers 102*b* to 102*i*, where the listener (i.e. the user 108 in this case) is capable of hearing an audio mix for surround sound in most optimized manner, i.e. the way intended to be heard.

Figure 2:
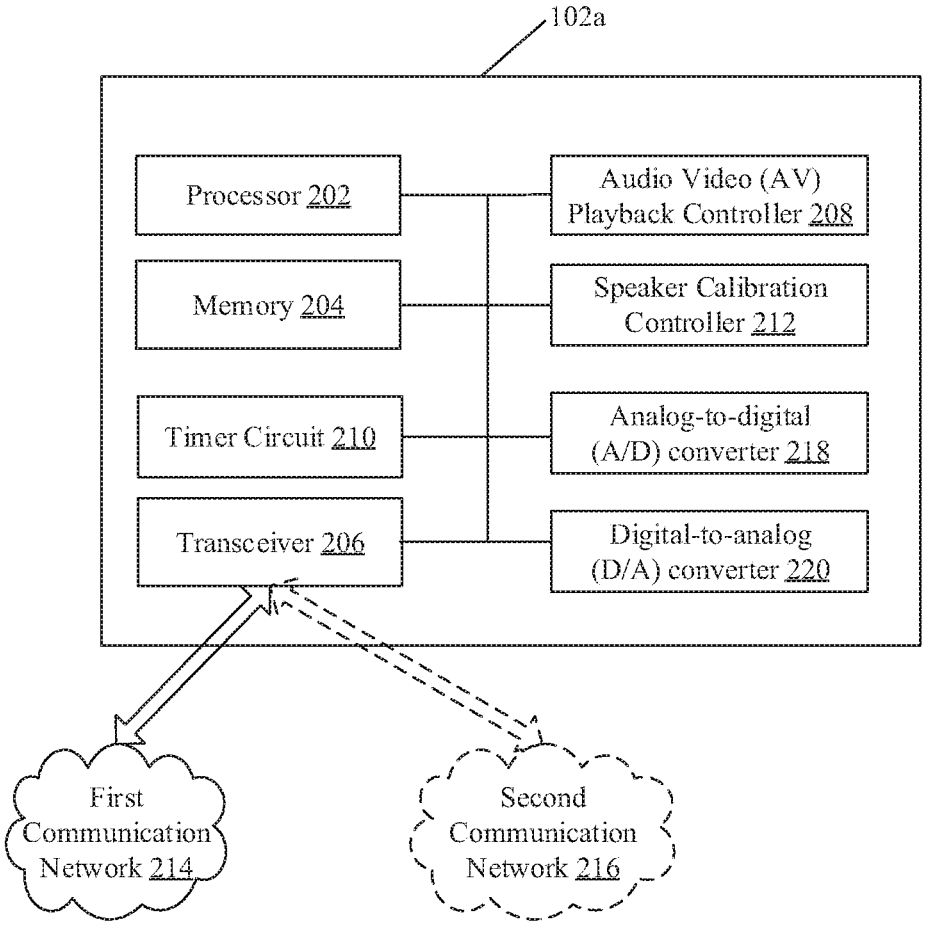
FIG. 2 is a block diagram that illustrates an exemplary control device of a speaker system, in accordance with an embodiment of the disclosure.

FIG. 2 is a block diagram that illustrates an exemplary control device of a speaker system, in accordance with an embodiment of the disclosure. FIG. 2 is explained in conjunction with elements from FIG. 1. With reference to FIG. 2, there is shown the control device 102*a* of the speaker system 102. The control device 102*a* may comprise a processor 202, a memory 204, a transceiver 206, a timer circuit 210, an audio-video (AV) playback controller 208, a speaker calibration controller 212, an analog-to-digital (A/D) converter 218, and a digital-to-analog (D/A) converter 220.

In accordance with an embodiment, the control device 102*a* may be communicatively coupled to the plurality of speakers 102*b* to 102*i* of the speaker system 102, via the first communication network 214, by use of the transceiver 206. The control device 102*a* may also be communicatively coupled to the electronic device 104 via the second communication network 216, by use of the transceiver 206. The processor 202 may be communicatively coupled to the memory 204, the transceiver 206, and/or the timer circuit 210, via a system bus.

The processor 202 may be a digital signal processor (DSP). In accordance with an embodiment, the processor 202 comprise suitable logic, circuitry, interfaces, and/or code that may be configured to execute a set of instructions stored in the memory 204. In some embodiments, the processor 202 may be implemented, based on a number of processor technologies known in the art. Examples of the processor 202 may be a microprocessor, a microcontroller, an X86-based processor, a Reduced Instruction Set Computing (RISC) processor, an Application-Specific Integrated Circuit (ASIC) processor, a Complex Instruction Set Computing (CISC) processor, and/or other processors.

The memory 204 may comprise suitable logic, circuitry, and/or interfaces that may be configured to store a set of instructions executable by the processor 202. The memory 204 may be further configured to store instructions or data associated with the AV playback controller 208 and speaker calibration controller 212. The memory 204 may further store information related to one or more configuration settings and/or one or more parameters related to calibration of the plurality of speakers 102*b* to 120*i* for reproduction of audio. The memory 204 may store multimedia AV content. Examples of implementation of the memory 204 may include, but not limited to, Random Access Memory (RAM), solid state drive (SSD), flash memory, Read Only Memory (ROM), and/or Hard Disk Drive (HDD).

In accordance with an embodiment, the transceiver 206 may be radio frequency (RF) receiver or transceiver. The transceiver 206 comprise suitable logic, circuitry, interfaces, and/or code that may be configured to communicate with an external electronic device, such as the electronic device 104, or a server (not shown), via the first communication network 214, or the second communication network 216. The transceiver 206 may implement known technologies to support wired or wireless communication. In some embodiments, the transceiver 206 may include, but is not limited to, an antenna, a RF transceiver, one or more amplifiers, a tuner, one or more oscillators, a digital signal processor, a coder-decoder (CODEC) chipset, a subscriber identity module (SIM) card, and/or a local buffer. The transceiver 206 may communicate via wireless communication with networks, such as the Internet, an Intranet and/or a wireless network, such as a cellular telephone network, a wireless local area network (LAN) and/or a metropolitan area network (MAN). The wireless communication may use any of a plurality of communication standards, protocols and technologies, such as Global System for Mobile Communications (GSM), Enhanced Data GSM Environment (EDGE), wideband code division multiple access (W-CDMA), code division multiple access (CDMA), time division multiple access (TDMA), Bluetooth, a Global Positioning System (GPS) network, Radio-Frequency communication based network (e.g., using FM/AM signals), Wireless Fidelity (Wi-Fi) (such as IEEE 802.11a, IEEE 802.11b, IEEE 802.11g and/or IEEE 802.11n), voice over Internet Protocol (VoIP), Li-Fi, Wi-MAX, a protocol for email, instant messaging, and/or Short Message Service (SMS).

The AV playback controller 208 may comprise suitable logic, circuitry, interfaces, and/or code that may be configured to control playback of the multimedia AV content, under the control of the processor 202. In accordance with an embodiment, the AV playback controller 208 may be configured to extract one or more audio and video segments from the multimedia AV content for playback. Further, the AV playback controller 208 may be configured to synchronize the one or more extracted audio and video segments for playback. In addition, the AV playback controller 208 may also identify various audio channels, such as the plurality of speakers 102*b* to 102*i*, associated with the one or more extracted audio segments. The AV playback controller 208 may output video frames of the multimedia AV content via a display device coupled to the control device 102*a*. In addition, the AV playback controller 208 may output audio of the multimedia AV content via the plurality of speakers 102*b* to 102*i*. In accordance with an embodiment, the AV playback controller 208 may be configured to communicate audio signals of the audio of the multimedia AV content to the plurality of speakers 102*b* to 102*i* of the speaker system 102 for reproduction of the audio. In accordance with an embodiment, the AV playback controller 208 may be a part of the processor 202. Alternatively, the AV playback controller 208 may be implemented as a separate processor or circuitry in the control device 102*a*. In accordance with an embodiment, the AV playback controller 208 and the processor 202 may be implemented as an integrated processor or a cluster of processors that perform the functions of the AV playback controller 208 and the processor 202. In accordance with an embodiment, the AV playback controller 208 may be implemented as a software module stored in the memory 204, which upon execution by the processor 202 may perform the functions of the AV playback controller 208.

The timer circuit 210 may comprise suitable logic, circuitry, interfaces, and/or code that may be configured to generate the first timing signal that may indicate the first time instant. The timer circuit 210 may refer to a customized clock. The first time instant may correspond to a time at which the AV playback controller 208 of the control device 102*a* may communicate the audio signals of the multimedia AV content to a first speaker (e.g., the speaker 102*b*) of the plurality of speakers 102*b* to 102*i*. In accordance with an embodiment, for generation of the first timing signal, the timer circuit 210 may initially generate a digital or analog signal with predefined characteristics (also referred as a carrier signal or a baseband signal). Thereafter, the timer circuit 210 may embed the information related to the first time instant upon the generated digital signal using one or more digital/analog modulation techniques known in the art. The information related to the first time instant may be represented in a predefined format, e.g., <year; month; day; hour; minute; second; milli-second; micro-second; nano-second>. In accordance with an embodiment, the timer circuit 210 may generate the first timing signal using at least one of a Global Positioning System (GPS)-based circuit, a radio frequency-based circuit, and/or a clock circuit provided in the control device 102*a*.

The speaker calibration controller 212 may comprise suitable logic, circuitry, interfaces, and/or code that may be configured to calibrate at least the first speaker (e.g., the speaker 102*b*) of the speaker system 102 for reproduction of the audio. In accordance with an embodiment, the speaker calibration controller 212 may be configured to generate known number of test audio samples (or audio tracks) and package the test audio samples in an audio signal (multi-channel audio). The generated test audio samples may be used for calibration of the plurality of speakers 102*b* to 102*i*, as discussed in FIG. 1. In accordance with an embodiment, the speaker calibration controller 212 may be configured to communicate the first timing signal indicative of the first time instant to the electronic device 104, via the second communication network 216, by use of the transceiver 206. Thereafter, the speaker calibration controller 212 may be configured to receive the second timing signal that may indicate the second timing signal, from the electronic device 104, via the second communication network 216. The second time instant may correspond to a time at which the electronic device 104 may record audio output from the first speaker (e.g., the speaker 102*b*) at a first location (such as the second listening position 112) within the listening area 106. Based on the first timing signal and the received second timing signal, the speaker calibration controller 212 may be configured to determine the first absolute distance between the first speaker (e.g., the speaker 102*b*) and the electronic device 104. In accordance with an embodiment, the determination of the first absolute distance may be based on a difference between the second time instant provided in the second timing signal, and the first time instant provided in the first timing signal. In accordance with an embodiment, the speaker calibration controller 212 may be configured to calibrate at least the first speaker (e.g., the speaker 102*b*) based on the first absolute distance.

The first communication network 214 may be configured to enable communication between the control device 102*a* and the plurality of speakers 102*b* to 102*i* of the speaker system 102. The first communication network 214 may be implemented by one or more wired or wireless communication technologies known in the art. Examples of the wired or wireless communication networks may include Internet, an Intranet, a cellular telephone network, a wireless local area network (LAN), and/or a metropolitan area network (MAN). In accordance with an embodiment, at least a portion of the first communication network 214 may be implemented based on Infra-red (IR) based, Bluetooth based, and/or Light-Fidelity (Li-Fi) based communication technology. For example, the AV playback controller 208 of the control device 102*a* may communicate audio signals of the audio associated with the multimedia AV content for reproduction of the audio to the first speaker (e.g., the speaker 102*b*), via the first communication network 214. Further, the speaker calibration controller 212 may communicate instructions related to speaker calibration parameters to the first speaker (e.g., the speaker 102*b*), via the first communication network 214.

The second communication network 216 may be configured to enable communication between the control device 102*a* and the electronic device 104. The second communication network 216 may be implemented by one or more wireless communication technologies known in the art. Examples of the wireless communication networks may include, but are not limited to the Internet, or a wireless local area network (WLAN). In accordance with an embodiment, at least a portion of the second communication network 216 may be implemented based on a wireless personal area network, such as Infra-red (IR) based, Bluetooth based, and/or Light-Fidelity (Li-Fi) based communication technology. For example, the speaker calibration controller 212 of the control device 102*a* may communicate the first timing signals to the electronic device 104 and may receive the second timing signals from the electronic device 104, via the second communication network 216. Further, the speaker calibration controller 212 may receive the first instruction for calibration of the first speaker (e.g., the speaker 102*b*) from the electronic device 104, via the second communication network 216.

The A/D converter 218 may comprise suitable logic, circuitry, interfaces, and/or code that may be configured to receive audio signal from the transceiver 206 (such as RF receiver or transceiver). The A/D converter 218 may be further configured to convert the audio signal received as analog signal to digital signal.

The D/A converter 220 may comprise suitable logic, circuitry, interfaces, and/or code that may be configured to receive processed audio signal from the processor 202 or the speaker calibration controller 212. The D/A converter 220 may be configured to convert the processed audio signal from the processor 202 or the speaker calibration controller 212 to analog audio signal for further communication via the transceiver 206 to the plurality of speakers 102*b* to 102*i*.

In operation, the AV playback controller 208 may be configured to playback the video frames of the multimedia AV content via the display device and the audio of the multimedia AV content to the plurality of speakers 102*b* to 102*i* of the speaker system 102. In accordance with an embodiment, the AV playback controller 208 may be configured to extract the one or more audio/video segments associated with audio/video content within the multimedia AV content. Further, the AV playback controller 208 may synchronize the playback of the one or more audio/video segments at the plurality of speakers 102*b* to 102*i* of the speaker system 102. In accordance with an embodiment, for the reproduction of audio, the AV playback controller 208 may communicate an audio signal to the first speaker (e.g., the speaker 102*b*), via the first communication network 214, at the first time instant.

A person having ordinary skill in the art may understand that the multimedia AV content may include audio-metadata that may associate one or more audio segments of the audio of the multimedia AV content with one or more speakers, such as one or more of the plurality of speakers 102*b* to 102*i*. In accordance with an embodiment, when a particular speaker (e.g., the speaker 102*b*) of the speaker system 102 outputs an audio signal designated for a particular speaker, a surround sound output may be created.

In accordance with an embodiment, the timer circuit 210 may be configured generate the first timing signal that may indicate the first time instant at which the AV playback controller 208 communicates an audio signal to the first speaker. Thereafter, the speaker calibration controller 212 may be configured to communicate the first timing signal to the electronic device 104, via the second communication network 216. The first speaker (e.g., the speaker 102*b*) may out an audio based on the receipt of the audio signal from the AV playback controller 208 of the control device 102*a*. On reception of the first timing signal by the electronic device 104, the electronic device 104, may record the audio output from the first speaker (e.g., the speaker 102*b*) at the second time instant. The audio output may be recorded by the electronic device 104 at a first location (e.g., the second listening position 112) within the listening area 106. The electronic device 104 may generate the second timing signal that may indicate the second time instant. Thereafter, the speaker calibration controller 212 may be configured to receive the second timing signal from the electronic device 104, via the second communication network 216. In accordance with an embodiment, the speaker calibration controller 212 may be configured to determine the first absolute distance (e.g., the first distance 116) between the first speaker (e.g., the speaker 102*b*) and the electronic device 104 based on the first timing signal and the second timing signal. In accordance with an embodiment, the determination of the first absolute distance may be based on a difference between the second time instant provided in the second timing signal, and the first time instant provided in the first timing signal. Thereafter, the speaker calibration controller 212 may be configured to calibrate at least the first speaker (e.g., the speaker 102*b*) for reproduction of the audio based at least on the determined first absolute distance. Alternatively, the electronic device 104 may be configured to determine the first absolute distance (e.g., the first distance 116) between the first speaker (e.g., the speaker 102*b*) and the electronic device 104 based on the first timing signal and the second timing signal.

In accordance with an exemplary aspect of the disclosure, the processor 202 of the control device 102*a* may be configured to receive the calibration start signal from the electronic device 104, via the transceiver 206. The receipt of the calibration start signal may occur via a personal wireless network, such as Bluetooth, or Wi-Fi. The control device 102*a* may be configured to retrieve a known audio signal that include known number of test audio samples. Based on the receipt of the calibration start signal, the processor 202 of the control device 102*a* may be configured to communicate the audio signal that include test audio samples, to each of the plurality of speakers 102*b* to 102*i* of the speaker system 102, at a certain time instant, referred to as the second time instant ("t2"), as described in FIG. 1. At this second time instant, the GPS timing information may be concurrently retrieved from an inbuilt GPS module of the control device 102*a*, and temporally stored. In some embodiments, instead of the inbuilt GPS module, the timer circuit 210 may be provided to note the time of communication of the audio signal that include test audio samples, to each of the plurality of speakers 102*b* to 102*i*. In addition, at this second time instant, the processor 202 of the control device 102*a* may also communicate a timing signal including the second time instant to the electronic device 104. The communication of the timing signal to the electronic device 104 may occur via a personal wireless network, such as Bluetooth, or Wi-Fi. The electronic device 104 may store the second time instant in the memory of the electronic device 104, upon reception of the timing signal from the control device 102*a*. Thereafter, the plurality of known test audio samples may be played-back by each of the plurality of speakers 102*b* to 102*i* one by one to output audio. The control device 102*a* may then receive an instruction to calibrate each of the plurality of speakers 102*b* to 102*i* from the electronic device 104. The instruction may include one or more calibration parameters, such as, but not limited to, volume settings, phase-settings, equalization settings, channel adjustments, and the like. The control device 102*a* may be configured to calibrate the plurality of speakers 102*b* to 102*i* concurrently based on the received instruction.

Figure 3:
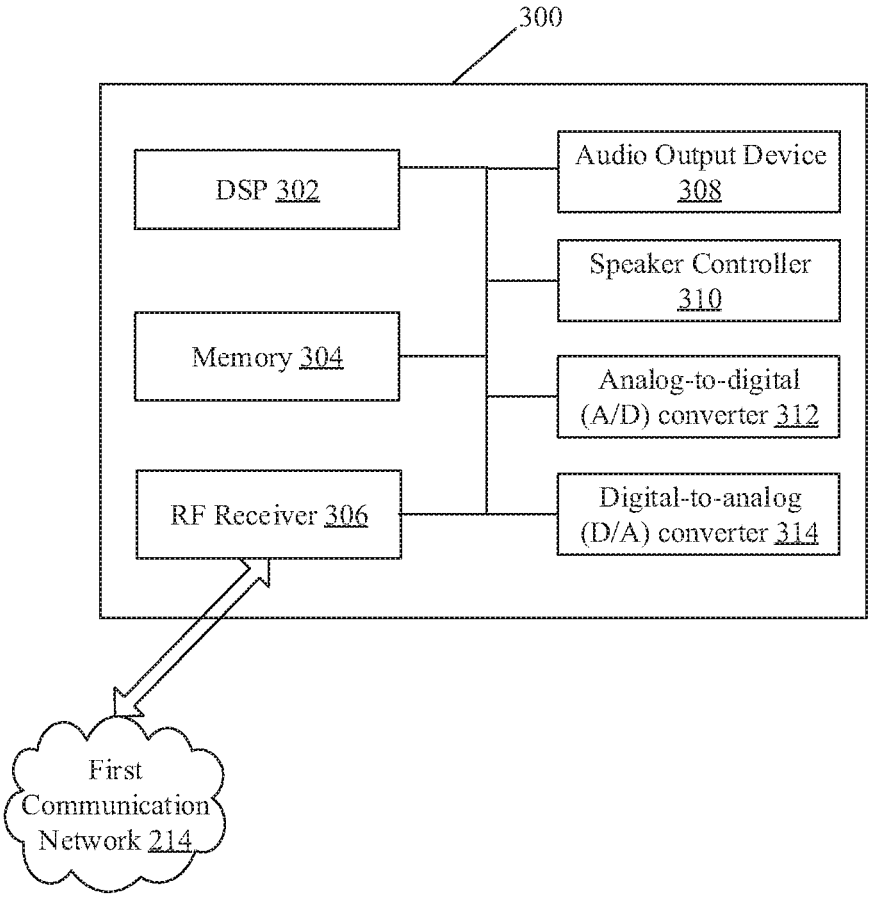
FIG. 3 is a block diagram that illustrates an exemplary speaker of a speaker system, in accordance with an embodiment of the disclosure.

FIG. 3 is a block diagram that illustrates an exemplary speaker of a speaker system, in accordance with an embodiment of the disclosure. FIG. 3 is explained in conjunction with elements from FIG. 1 and FIG. 2. With reference to FIG. 3, there is shown a speaker 300. For the purpose of explanation, the speaker 300 is considered as the first speaker (e.g., the speaker 102*b*). However, any speaker of the speaker system 102 may include similar components. The first speaker (e.g., the speaker 102*b*) may comprise a digital signal processor (DSP) 302, a memory 304, a RF receiver 306, an audio output device 308, a speaker controller 310, an analog-to-digital (A/D) converter 316, and a digital-to-analog (D/A) converter 318. In accordance with an embodiment, the first speaker (e.g., the speaker 102*b*) may be communicatively coupled to the control device 102*a* via the first communication network 214, by use of the RF receiver 306. The DSP 302 may be communicatively coupled to the memory 304, the RF receiver 306, the audio output device 308, and/or the speaker controller 310, via a system bus.

In accordance with an embodiment, the first speaker (e.g., the speaker 102*b*) may correspond to an audio output device that may include one or more logic, circuitry, and/or codes configured to output audio associated with the multimedia AV content. In accordance with an embodiment, the first speaker (e.g., the speaker 102*b*) may be configured to receive audio signals associated with the audio from the control device 102*a* for reproduction of the audio, via the first communication network 214. In accordance with an embodiment, the first speaker (e.g., the speaker 102*b*) may receive one or more calibration parameters for the calibration of the first speaker (e.g., the speaker 102*b*), from the control device 102*a*, via the first communication network 214. The one or more calibration parameters may be generated by the control device 102*a* based on the determination of the first absolute distance between the first speaker (e.g., the speaker 102*b*) and the electronic device 104.

The DSP 302 may comprise suitable logic, circuitry, interfaces, and/or code that may be configured to process audio and video signals received from the control device 102*a* for audio output. The DSP 302 may be implemented based on a number of processor technologies known in the art. Examples of the DSP 302 may be a microprocessor, a microcontroller, an X86-based processor, a Reduced Instruction Set Computing (RISC) processor, an Application-Specific Integrated Circuit (ASIC) processor, a Complex Instruction Set Computing (CISC) processor, and/or other processors.

The memory 304 may comprise suitable logic, circuitry, and/or interfaces that may be configured to store a set of instructions executable by the DSP 302. The memory 304 may be further configured to temporally store the audio signals received from the control device 102*a* as audio buffer for playback. In addition, the memory 304 may further temporally store one or more audio segments of the audio signal as the audio buffer. Further, the memory 304 may store the received one or more calibration parameters. A person of ordinary skill in the art may understand that the memory may also be configured to store instructions/code/data associated with audio output device 308 and/or the speaker controller 310. Examples of implementation of the memory 304 may include, but not limited to, RAM, ROM, HDD, SSD, or a flash drive.

The RF receiver 306 may comprise suitable logic, circuitry, interfaces, and/or code that may be configured to receive audio/video signals from the control device 102*a*, via the first communication network 214. The RF receiver 306 may implement known technologies to support wired or wireless communication. The RF receiver 306 may include, but is not limited to, an antenna, a radio frequency (RF) transceiver, one or more amplifiers, a tuner, one or more oscillators, a coder-decoder (CODEC) chipset, a subscriber identity module (SIM) card, and/or a local buffer. In some embodiments, the RF receiver 306 may communicate via wireless communication with networks, such as the Internet, an Intranet, and/or a wireless network, such as a cellular telephone network, a wireless local area network (LAN) and/or a metropolitan area network (MAN). The wireless communication may use a plurality of communication standards, protocols and technologies, such as a Global System for Mobile Communications (GSM), Enhanced Data GSM Environment (EDGE), wideband code division multiple access (W-CDMA), code division multiple access (CDMA), time division multiple access (TDMA), Bluetooth, Wireless Fidelity (Wi-Fi) (such as IEEE 802.11a, IEEE 802.11b, IEEE 802.11g and/or IEEE 802.11n), LiFi, a Global Positioning System (GPS)-based network, voice over Internet Protocol (VoIP), Wi-MAX, a protocol for email, instant messaging, and/or Short Message Service (SMS).

The audio output device 308 may comprise suitable logic, circuitry, interfaces, and/or code that may be configured to output audio associated with the audio signals received from the control device 102*a*. In accordance with an embodiment, the audio output device 308 may include an electro-acoustic transducer (a loud-speaker) that may be configured to convert electrical audio signals into corresponding audio output. In accordance with an embodiment, the audio output device 308 may be a part of the DSP 302. Alternatively, the audio output device 308 may be implemented as a separate processor or circuitry in the first speaker (e.g., the speaker 102*b*). In accordance with an embodiment, the audio output device 308 and the DSP 302 may be implemented as an integrated processor or a cluster of processors that perform the functions of the audio output device 308 and the DSP 302. In accordance with an embodiment, the audio output device 308 may be implemented as a set of instructions stored in the memory 304, which upon execution by the DSP 302 may perform the functions of the audio output device 308.

The speaker controller 310 may comprise suitable logic, circuitry, interfaces, and/or code that may be configured to control an operation of the first speaker (e.g., the speaker 102*b*). Further, the speaker controller 310 may be configured to receive the one or more calibration parameters for the calibration of the first speaker (e.g., the speaker 102*b*) for the reproduction of the audio, from the control device 102*a*, via the first communication network 214. Thereafter, the speaker controller 310 may calibrate the output of the audio from the audio output device 308, based on the received one or more calibration parameters. In accordance with an embodiment, the speaker controller 310 may be a part of the DSP 302. Alternatively, the speaker controller 310 may be implemented as a separate processor or circuitry in the first speaker (e.g., the speaker 102*b*). In accordance with an embodiment, the speaker controller 310 and the DSP 302 may be implemented as an integrated processor or a cluster of processors that perform the functions of the speaker controller 310 and the DSP 302. In accordance with an embodiment, speaker controller 310 may be implemented as a set of instructions stored in the memory 304, which upon execution by the DSP 302 may perform the functions of the speaker controller 310.

The A/D converter 312 may comprise suitable logic, circuitry, interfaces, and/or code that may be configured receive audio signal from the RF receiver 306. The A/D converter 312 may be further configured to convert the audio signal received as analog signal to digital signal.

The D/A converter 314 may comprise suitable logic, circuitry, interfaces, and/or code that may be configured to receive processed audio signal from DSP 302 or the speaker controller 310. The D/A converter 314 may be configured to convert the processed audio signal from the speaker controller 310 to analog audio signal for output via the audio output device 308.

In operation, the RF receiver 306 may be configured to receive an audio signal for reproduction of audio, from the control device 102*a*. In some embodiments, the A/D converter 312 may be configured to convert the audio signal received as analog signal to digital signal. The DSP 302 may be configured to process the audio signal and communicate to the speaker controller 310. The speaker controller 310 may control the playback of the audio via the audio output device 308. For example, the speaker controller 310 may extract one or more audio segments from the audio signal, for playout via the audio output device 308. The A/D converter 314 may be configured to convert the processed audio signal from the speaker controller 310 to analog audio signal for output via the audio output device 308. Thereafter, the audio output device 308 may output the audio associated with the audio signal, under the control of the speaker controller 310 (and/or the DSP 302).

In accordance with an embodiment, the speaker controller 310 may be configured to receive the one or more calibration parameters for the calibration of the first speaker (e.g., the speaker 102*b*) for the reproduction of the audio, by use of the RF receiver 306. The one or more calibration parameters may be received from the control device 102*a*, via the first communication network 214, such as a RF carrier signal. Thereafter, the speaker controller 310 may calibrate the output of the audio from the audio output device 308, based on the received one or more calibration parameters.

Figure 4:
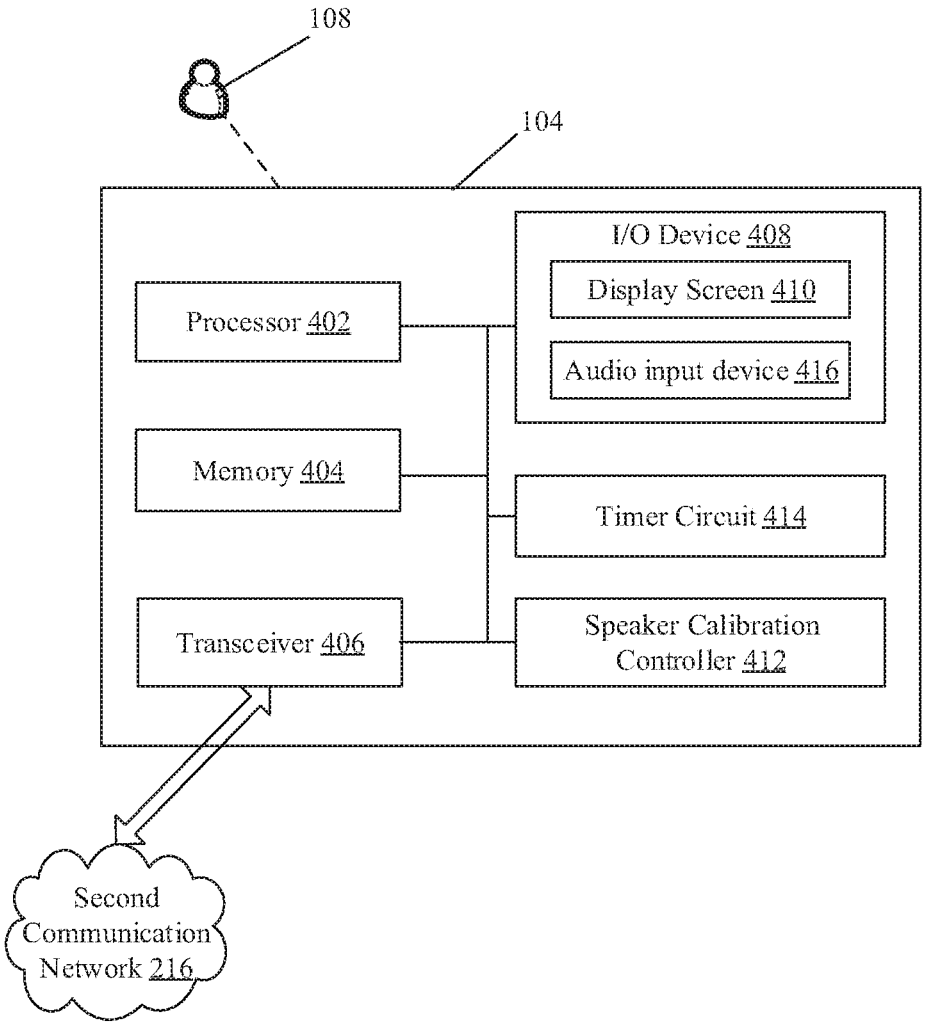
FIG. 4 is a block diagram that illustrates an exemplary electronic device associated with a user, in accordance with an embodiment of the disclosure.

FIG. 4 is a block diagram that illustrates an exemplary electronic device associated with a user, in accordance with an embodiment of the disclosure. FIG. 4 is explained in conjunction with elements from FIG. 1. With reference to FIG. 4, there is shown the electronic device 104 associated with the user 108. The electronic device 104 may comprise a processor 402, a memory 404, a transceiver 406, an I/O device 408, a speaker calibration controller 412, and a timer circuit 414. The I/O device 408 may further comprise a display screen 410 and an audio input device 416. In accordance with an embodiment, the electronic device 104 may be communicatively coupled to one or more other electronic devices or servers, via the second communication network 216, by use of the transceiver 406. The processor 402 may be communicatively coupled to the memory 404, the transceiver 406, the I/O device 408, the timer circuit 414, speaker calibration controller 412, and/or the audio input device 416, via a system bus.

The processor 402 may comprise suitable logic, circuitry, interfaces, and/or code that may be configured to execute a set of instructions stored in the memory 404. The processor 402 may be implemented, based on a number of processor technologies known in the art. Examples of the processor 402 may be an X86-based processor, a Reduced Instruction Set Computing (RISC) processor, an Application-Specific Integrated Circuit (ASIC) processor, a Complex Instruction Set Computing (CISC) processor, and/or other processors.

The memory 404 may comprise suitable logic, circuitry, and/or interfaces that may be configured to store a set of instructions executable by the processor 402. The memory 404 may be further configured to store information received from the control device 102*a*, such as, the first timing signal and/or the first time instant. In addition, the memory 404 may be configured to store the second timing signal and/or the second time instant. Examples of implementation of the memory 404 may include, but not limited to, Random Access Memory (RAM), Read Only Memory (ROM), Hard Disk Drive (HDD), and/or a Secure Digital (SD) card.

The transceiver 406 may comprise suitable logic, circuitry, interfaces, and/or code that may be configured to communicate with another electronic device or a server (not shown), via the second communication network 216. The transceiver 406 may implement known technologies to support wired or wireless communication.

The I/O device 408 may comprise suitable logic, circuitry, interfaces, and/or code for various input and output devices that may be configured to communicate with the processor 402. The I/O device 408 may be configured to receive an input from the user 108. Further, the I/O device 408 may be configured to control the output of the display screen 410. In accordance with an embodiment, the user 108 may use the I/O device 408 to control various operations of the electronic device 104, such as configuring/operating the speaker system 102, and so on. For example, the user 108 may use the I/O device 408 to select and control playback of the multimedia AV content, including the output of the audio via the plurality of speakers 102*b* to 102*i*. Further, the user 108 may operate the I/O device 408 to perform calibration of at least the first speaker (e.g., the speaker 102*b*) and/or shift the acoustic sweet-spot of the speaker system 102, based on speaker calibration. Examples of the input devices may include, but may not be limited to, an imaging unit, a camcorder, a touch screen, a keyboard, a mouse, a joystick, the audio input device 416 (such as a microphone), a motion sensor, a light sensor, and/or a docking station. Examples of the output devices may include, but not limited to, the display screen 410, a projector screen, and/or a speaker.

The display screen 410 may comprise suitable circuitry and/or interfaces that may be configured to display an application interface of an application installed in the memory 204. The application may be used to initiate calibration process by the user 108. The display screen 410 may be configured to simultaneously receive one or more input actions from the user 108, via a touch-sensitive screen. Such one or more input actions may be received from the user 108 by means of a virtual keypad, a stylus, touch-based input actions, and/or a gesture. The display screen 410 may be realized via several known technologies such as, but not limited to, Liquid Crystal Display (LCD) display, Light Emitting Diode (LED) display, plasma display, and/or Organic LED (OLED) display technology.

The speaker calibration controller 412 may comprise suitable logic, circuitry, interfaces, and/or code that may be configured to generate the first instruction to calibrate at least the first speaker (e.g., the speaker 102*b*) for reproduction of the audio. Thereafter, the first instruction may be communicated to the control device 102*a*, via the second communication network 216. In accordance with an embodiment, the speaker calibration controller 412 may generate the second instruction to shift the acoustic sweet-spot of the speaker system 102 from a first location (e.g., the first listening position 110) to a second location (e.g., the second listening position 112). The shifting of the acoustic sweet-spot may be performed based on calibration of the plurality of speakers 102*b* to 102*i*. The acoustic sweet-spot may correspond to location of focus of the audio output of the plurality of speakers 102*b* to 102*i*. In accordance with an embodiment, the second instruction may be communicated to the control device 102*a*, via the second communication network 216. In accordance with an embodiment, the speaker calibration controller 412 may be a part of the processor 402. Alternatively, the speaker calibration controller 412 may be implemented as a separate processor or circuitry in the electronic device 104. In accordance with an embodiment, the speaker calibration controller 412 and the processor 402 may be implemented as an integrated processor or a cluster of processors that perform the functions of the speaker calibration controller 412 and the processor 402. In accordance with an embodiment, the speaker calibration controller 412 may be implemented as a speaker calibration engine stored in the memory 404, which upon execution by the processor 402, may perform the functions of the speaker calibration controller 412.

The timer circuit 414 may comprise suitable logic, circuitry, interfaces, and/or code that may be configured to generate the second timing signal that may indicate the second time instant. The second time instant may correspond to a time at which the electronic device 104 may record the audio output from the first speaker (e.g., the speaker 102*b*). In accordance with an embodiment, for generation of the first timing signal, the timer circuit 414 may initially generate a digital or analog signal with predefined characteristics (also referred as a carrier signal or a baseband signal). Thereafter, the timer circuit 414 may embed the information related to the second time instant upon the generated digital/analog carrier/baseband signal using one or more digital/analog modulation techniques known in the art. The information related to the second time instant may be represented in a predefined format, e.g., <year; month; day; hour; minute; second; milli-second; micro-second; nano-second>. In accordance with an embodiment, the timer circuit 414 may generate the first timing signal using at least one of a Global Positioning System (GPS)-based circuit, a radio frequency-based circuit, and/or a timer circuit provided in the processor 402.

The audio input device 416 may comprise suitable logic, circuitry, interfaces, and/or code that may be configured to receive audio output. For example, the audio input device 416 may record the audio output of the first speaker (e.g., the speaker 102*b*). In accordance with an embodiment, the audio input device 416 may include a transducer (a micro-phone) that may be configured to convert input audio into corresponding electric audio signals.

In operation, the electronic device 104 may include a pre-installed application that may be configured to operate, control, and/or calibrate the plurality of speakers 102*b* to 102*i* of the speaker system 102, based on input from the user 108. In accordance with an embodiment, the user 108 may use the pre-installed application via the application interface presented via the display screen 410 of the I/O device 408. The user 108 may provide an input via the application interface to initiate the calibration of the first speaker (e.g., the speaker 102*b*).

The processor 402 of the electronic device 104 may generate a calibration start signal based on user input received from the user 108 via the UI. The calibration start signal may then be communicated by the electronic device 104 to the control device 102*a* that is a communicatively coupled to the plurality of speakers 102*b* to 102*i* of the speaker system 102. The time instant, such as a first time instant, at which the calibration start signal is communicated to the control device 102*a* may be stored in the memory 404 of the electronic device 104. At this first time instant, the sound sensors, such as audio input device 416, of the electronic device 104, may also be activated to start recording so that when known audio samples are outputted from the plurality of speakers 102*b* to 102*i* one by one at a plurality of different time instants latter on, the audio samples may be recorded at the electronic device 104 by the audio input device 416. In other words, when the user 108 initiates the process of calibration, a the timer circuit 414 may be noted down the then time instant and the recording is started at the electronic device 104 (such as a smartphone). Thus, the first time instant stored in the memory 404 refers to the timing information at the time of communication of the calibration start signal. The timing information may be retrieved from the timer circuit 414, such as an inbuilt GPS module, of the electronic device 104.

Based on the receipt of the calibration start signal, the control device 102*a* may note the GPS timing and communicate an audio signal that include known number of test audio samples, to each of the plurality of speakers 102*b* to 102*i* of the speaker system 102, at the second time instant "t2". The audio signal is a known signal comprising "X" number of audio samples, where "X" corresponds to number of channels in the speaker system 102, such as the plurality of speakers 102*b* to 102*i*. In addition, at this second time instant, the control device 102*a* may also communicate a timing signal including the second time instant to the electronic device 104. The communication of the timing signal to the electronic device 104 may occur via a personal wireless network, such as Bluetooth, or Wi-Fi. The electronic device 104 may receive and store the second time instant in the memory 404 of the electronic device 104, upon reception of the timing signal from the control device 102*a*. Thereafter, the plurality of known test audio samples may be played-back by each of the plurality of speakers 102*b* to 102*i* one by one to output audio. Out of the "X" number of samples, one sample is output by one speaker at a particular time instant.

In accordance with an embodiment, the audio input device of 416 of the electronic device 104 may record output of the audio samples from each of the plurality of speakers 102*b* to 102*i* at different time instants, depending on when the audio is output from the respective speakers 102*b* to 102*i*. The processor 402 of the electronic device 104 located in the vicinity of the speaker system 102 may store the different time instants, related to the audio output recorded from the respective speakers 102*b* to 102*i*, in the memory 404 of the electronic device 104. Thereafter, the processor 402 may be configured to determine a plurality of absolute distances between each of the plurality of speakers 102*b* to 102*i*, and the electronic device 104. The determination of the absolute distance between a speaker (e.g., the speaker 102*b*) and the electronic device 104 may be based on the first time difference (that may be referred to as "td1") between the second time instant ("t2") and the time instant (of the plurality of different time instants) associated with recording of the audio sample from the respective speaker (e.g., the speaker 102*b*), sample difference or sample number "d1", as discussed in FIG. 1. Similarly for other speakers of the speaker system 102, the plurality of absolute distances between each of the plurality of speakers 102*b* to 102*i*, and the electronic device 104, may be determined.

Further, the processor 404 may be configured to determine an orientation of each of the plurality of speakers 102*b* to 102*i* with respect to the electronic device 104, based on the determined respective absolute distances. To that end, the processor 404 may be configured to determine the plurality of absolute distances between each of the plurality of speakers 102*b* to 102*i*, at the first location of the user 108 of the electronic device 104. Thereafter, the processor 404 may determine a second plurality of absolute distances of the plurality of speakers 102*b* to 102*i* with respect to the electronic device 104, at a second location of the user 108. The determination of the orientation of each speaker may be based on the respective absolute distances of the speaker from the electronic device 104, at the first location and the second location of the user of the electronic device 104. The orientation determination based on angle computation is described, for example, in the FIG. 6.

The speaker calibration controller 412 may then be configured to generate an instruction to calibrate each of the plurality of speakers 102*b* to 102*i* based at least on the determined respective absolute distances. The instruction may include one or more calibration parameters, such as, but not limited to, volume settings, phase-settings, equalization settings, channel adjustments, and the like. The speaker calibration controller 412 may communicate the generated instruction to the control device 102*a*, via the second communication network 216, which may calibrate the plurality of speakers 102*b* to 102*i* concurrently based on the received instruction. Thus, as the user 108 moves from the first listening position 110, to the second listening position 112, the plurality of absolute distances of the plurality of speakers 102*b* to 102*i* with respect to the electronic device 104, at the second listening position 112 of the user 108, may be re-calculated. The acoustic sweet spot of the speaker system 102 may be shifted from the first listening position 110, to the second listening position 112, based on calibration of the plurality of speakers 102*b* to 102*i* of the speaker system 102 for the second listening position 112 for reproduction of the one or more audio segments suitable for the second listening position 112.

In some embodiments, the absolute distances are determined at the control device 102*a* instead of the electronic device 104. In such cases, the speaker calibration controller 412 may be configured to communicate the generated second timing signal to the control device 102*a*, via the second communication network 216. The control device 102*a* may determine the first absolute distance (e.g., the first distance 116) between the first speaker (e.g., the speaker 102*b*) and the electronic device 104, based on the first and the second timing signals. Similarly, the control device 102*a* may determine the plurality of absolute distances based on time instant of communication of the audio signal to the plurality of speakers 102*b* to 102*i* and the different time instants at which the known audio sample of the audio signal are recorded at the electronic device 104, as described in FIG. 1. The control device 102*a* may concurrently determine the plurality of absolute distances (including the first absolute distance) between each of the plurality of speakers 102*b* to 102*i*, and the electronic device 104. Thereafter, the control device 102*a* may calibrate the first speaker (e.g., the speaker 102*b*) and other speakers 102*c* to 102*i* based on the determined first absolute distance and other absolute distances of the plurality of absolute distances.

Figure 5:
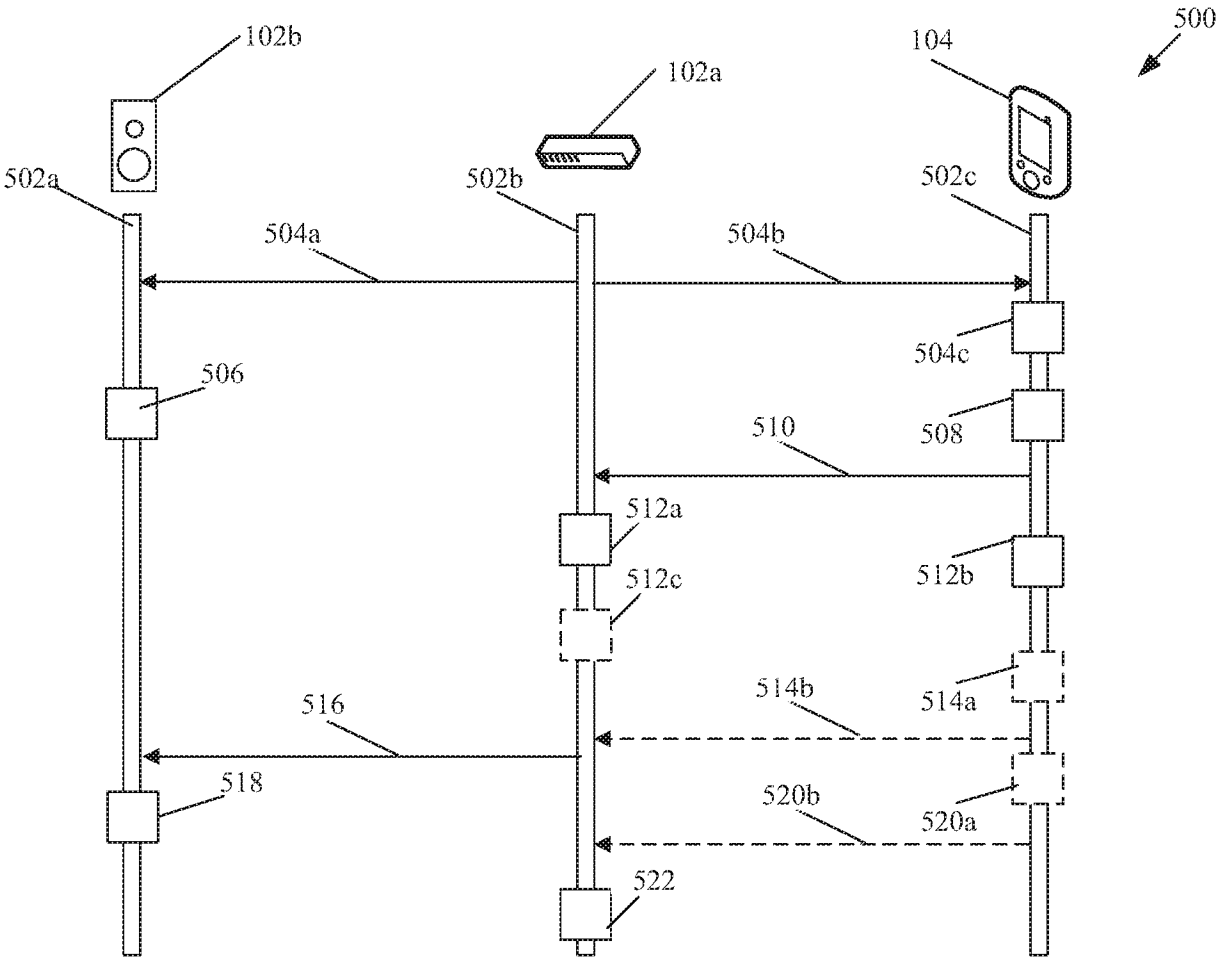
FIG. 5 illustrates an exemplary sequence diagram to depict calibration of a plurality of speakers of a speaker system by speaker position identification with respect to a user based on timing information for enhanced sound adjustment, in accordance with an embodiment of the disclosure.

FIG. 5 illustrates an exemplary sequence diagram to depict calibration of a plurality of speakers of a speaker system, in accordance with an embodiment of the disclosure. With reference to FIG. 5, there is a shown a sequence diagram 500, which is described in conjunction with elements from FIGS. 1, 2, 3, and 4. The sequence diagram 500 includes the control device 102*a* of the speaker system 102, the first speaker (e.g., the speaker 102*b*), and the electronic device 104 associated with the user 108. There is further shown a first timeline 502*a*, a second timeline 502*b*, and a third timeline 502*c*. In accordance to the sequence diagram 500, the first timeline 502*a* may correspond to a timeline that shows operations associated with the first speaker (e.g., the speaker 102*b*). The second timeline 502*b* may correspond to a timeline that illustrates operations associated with the control device 102*a*. The third timeline 502*c* may correspond to a timeline that illustrates operations associated with the electronic device 104.

At 504*a*, the control device 102*a* may communicate an audio signal to the first speaker (e.g., the speaker 102*b*), via the first communication network 214. The AV playback controller 208 of the control device 102*a* may be configured to communicate the audio signal after reception of the multimedia AV content from a content source and extraction of the audio segments to generate the audio signal. The AV playback controller 208 may communicate the audio signal at the first time instant.

At 504*b*, the control device 102*a* may communicate the first timing signal to the electronic device 104. The first timing signal may indicate the first time instant at which the audio signal is communicated to the first speaker (e.g., the speaker 102*b*). The timer circuit 210 of the control device 102*a* may be configured to generate the first timing signal. In some embodiments, instead of the timer circuit 210, a GPS-based circuit, a radio frequency-based circuit associated with the processor 202 of the control device 102*a*. In such cases, the control device 102*a* may include the GPS-based circuit and may receive GPS signals using the GPS-based circuit. At the same time instant when the audio signal is communicated to the first speaker (e.g., the speaker 102*b*), by the control device 102*a*, a timestamp of a GPS signal received by the control device 102*a* may be recorded. Thus, in such a case, the first timing signal may correspond to the recorded timestamp of the GPS signal received by the control device 102*a* at the same time instant at which the audio signal was communicated to the first speaker (e.g., the speaker 102*b*), by the control device 102*a*. In case of a RF signal, the first timing signal may correspond to a timestamp of the RF signal received by the control device 102*a* using the radio frequency-based circuit. The timestamp of the RF signal refers to the time instant at which the audio signal (for example, FM audio) was communicated to the first speaker (e.g., the speaker 102*b*), by the control device 102*a*.

At 504*c*, the electronic device 104 may be configured to monitor audio from its vicinity. The audio input device 416 of the electronic device 104 may be initialized and enabled to start the monitoring of the audio on reception of the first timing signal.

At 506, the first speaker (e.g., the speaker 102*b*) may be configured to initiate playback of the received audio signal and output the audio. The speaker controller 310 may initiate the playback of the received audio signal, via the audio output device 308 at the second time instant.

At 508, the electronic device 104 may record the audio output from the first speaker (e.g., the speaker 102*b*). The audio input device 416 may detect audio from the first speaker (e.g., the speaker 102*b*) and start to record the audio at the second time instant.

At 510, the electronic device 104 may communicate the second timing signal to the control device 102*a*. The second timing signal may indicate the second time instant. The timer circuit 414 may be configured to generate the second timing signal. In some embodiments, instead of the timer circuit 210, one of a GPS-based circuit or a radio frequency-based circuit may be used for the second timing signal.

At 512*a*, the control device 102*a* may be configured to determine the first absolute distance (e.g., the first distance 116) between the first speaker (e.g., the speaker 102*b*) and the electronic device 104 based on the second timing signal and the first timing signal. The determination of the first absolute distance may be based on a difference between the second time instant provided in the second timing signal, and the first time instant provided in the first timing signal. The speaker calibration controller 212 may be configured to determine the first absolute distance.

At 512*b*, the electronic device 104 may be configured to determine the first absolute distance in a manner similar to operation 512*a*. The speaker calibration controller 412 of the electronic device 104 may be configured to determine the first absolute distance.

At 512*c*, the control device 102*a* may be configured to determine the first orientation of the first speaker (e.g., the speaker 102*b*) with respect to the electronic device 104. The first orientation may be determined based on the distance between two different locations of the electronic device 104 within the listening area 106, and the first absolute distance. The speaker calibration controller 212 may be configured to determine the first orientation. In accordance with an embodiment, the operation 512*c* may also be performed by the electronic device 104.

At 514*a*, the electronic device 104 may be configured to generate the first instruction for calibration of the first speaker (e.g., the speaker 102*b*) for reproduction of the audio. The speaker calibration controller 412 may be configured to generate the first instruction based on the determined the first absolute distance. In addition, the generation of the first instruction may be done based on user-input received from the user 108 by the electronic device 104 via an application interface rendered on the electronic device 104.

At 514*b*, the electronic device 104 may be configured to communicate the generated first instruction to the control device 102*a*, via the second communication network 216. The speaker calibration controller 412 may be configured to communicate the generated first instruction to the control device 102*a*.

At 516, the control device 102*a* may be configured to communicate one or more calibration parameters to at least the first speaker (e.g., the speaker 102*b*). In some embodiments, the control device 102*a* may be configured to communicate one or more calibration parameters to the plurality of speakers 102*b* to 102*i*. Examples of the one or more calibration parameters include, but are not limited to, a modification of volume level, a bass level, a direction of sound wave, and/or one or more audio equalization settings. The speaker calibration controller 212 may be configured to determine the one or more calibration parameters for the calibration of the first speaker (e.g., the speaker 102*b*) based on the first absolute distance, the first orientation, and/or the first instruction. Similarly, the speaker calibration controller 212 may be configured to determine the one or more calibration parameters for the calibration of plurality of speakers 102*b* to 102*i*. Thereafter, the speaker calibration controller 212 may be configured to communicate the one or more calibration parameters to the first speaker (e.g., the speaker 102*b*), via the first communication network 214.

At 518, the first speaker (e.g., the speaker 102*b*) may be configured to adjust one or more configuration parameters and settings, based on the received one or more calibration parameters. The speaker controller 310 of the first speaker (e.g., the speaker 102*b*) may configured to control the audio output reproduction from the audio output device 308, based on the one or more calibration parameters. For example, the speaker controller 310 may increase volume-level of the first speaker (e.g., the speaker 102*b*) when the first absolute distance is greater than a pre-defined threshold. Further, the phase, and/or time-delay associated with audio signal output from the first speaker (e.g., the speaker 102*b*) may be adjusted based on the one or more configuration parameters to calibrate the first speaker (e.g., the speaker 102*b*). It may be understood that, for the sake of brevity, the adjustment of the one or more configuration parameters and settings, is described with respect to first speaker (e.g., the speaker 102*b*), however, all the speakers 102*b* to 102*i* of the speaker system 102 may be concurrently calibrated and the configuration parameters and settings may be accordingly adjusted.

At 520*a*, the electronic device 104 may be configured to generate the second instruction to shift the acoustic sweet-spot of the speaker system 102 from the first listening position 110, to the second listening position 112. The shift of the acoustic sweet-spot may be based on calibration of the plurality of speakers 102*b* to 102*i* of the speaker system 102 for reproduction of one or more audio segments at the plurality of speakers 102*b* to 102*i*. The speaker calibration controller 412 may be configured to generate the second instruction based on the determined the first absolute distance and/or the first orientation. In addition, the second instruction may be the generated based on a user-input received from the user 108 by the electronic device 104 via the application interface.

At 520*b*, the electronic device 104 may be configured to communicate the generated second instruction to the control device 102*a*, via the second communication network 216. The speaker calibration controller 412 may be configured to communicate the generated first instruction to the control device 102*a*.

At 522, the control device 102*a* may shift the acoustic sweet-spot of the speaker system 102 from the first listening position to the second listening position. The speaker calibration controller 212 may be configured to calibrate the plurality of speakers 102*b* to 102*i* of the speaker system 102 for reproduction of the one or more audio segments of the audio. Thereafter, based on the second instruction, the speaker calibration controller 212 may be configured to shift the acoustic sweet-spot of the speaker system 102 from the first listening position 110, to the second listening position 112.

The exemplary sequence diagram described above is an exemplary alternative embodiment, where the absolute distance computation may be done at the control device 102*a* or the electronic device 104. In accordance with an exemplary aspect of the disclosure, the electronic device 104 held by the user 108 may initiate the calibration the plurality of speakers 102*b* to 102*i* of the speaker system 102 based on a current position of the electronic device 104 and the plurality of speakers 102*b* to 102*i* and the electronic device 104. An application installed in the electronic device 104, may be used to initiate, and automatically calibrate the plurality of speakers 102*b* to 102*i* of the speaker system 102 for enhanced sound experience. The user 108 of the electronic device 104 may provide an input to initiate the speaker calibration through a user-interface of the application. On reception of the user-input, the electronic device 104 may generate a calibration start signal. The operations related to the calibration of the plurality of speakers 102*b* to 102*i* based on the calibration start signal have been described in details, for example, in FIGS. 1, 4, and 10.

Figure 6:
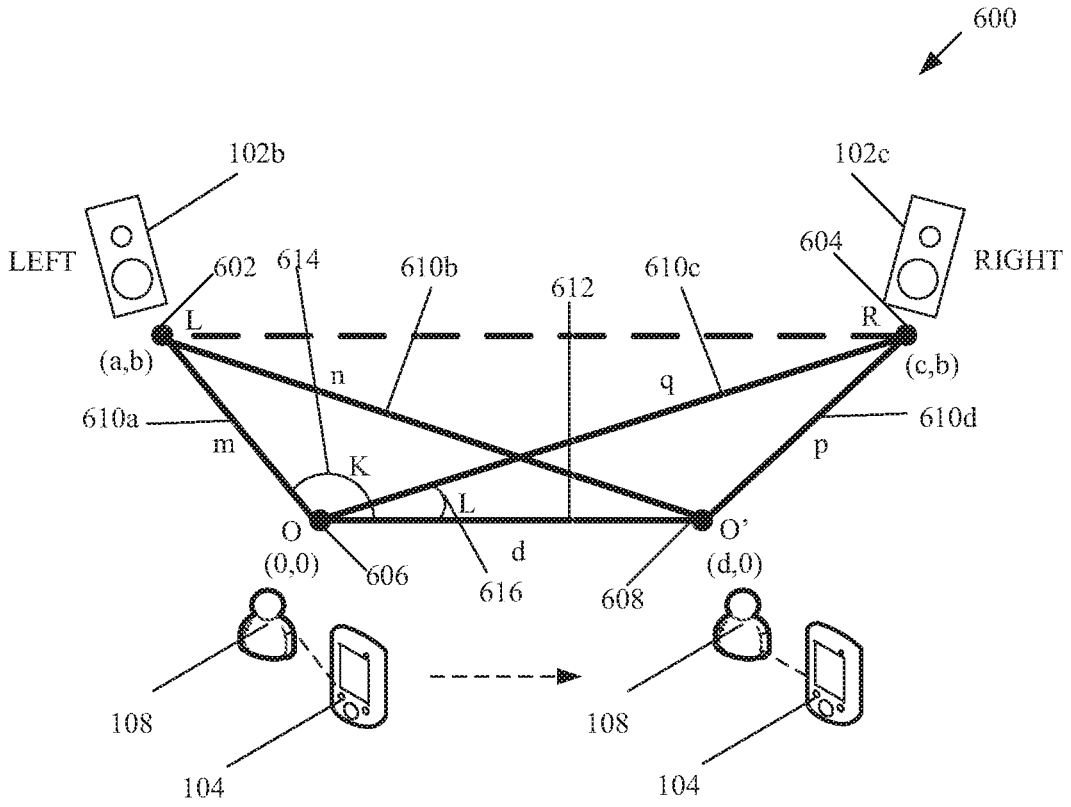
FIG. 6 illustrate exemplary scenarios to determine an absolute distance and an orientation of a speaker of a speaker system with respect to an electronic device associated with a user, in accordance with an embodiment of the disclosure.

FIG. 6 illustrates an exemplary scenario to determine a distance and an orientation of a speaker of a speaker system with respect to an electronic device, in accordance with an embodiment of the disclosure. With reference to FIG. 6, there is shown an exemplary scenario 600.

The exemplary scenario 600 of FIG. 6 may include the electronic device 104 of the user 108, the first speaker (e.g., the speaker 102*b*) and the second speaker (e.g., the speaker 102*c*). As depicted in FIG. 6, the first speaker (e.g., the speaker 102*b*) may be lie towards left-side of the user 108, while the second speaker (e.g., the speaker 102*c*) may lie towards right-side of the user 108. The exemplary scenario 600 further illustrates various locations 602, 604, 606, and 608 in the listening area 606 (FIG. 1). The location 602 (also represented by "L" and coordinates (a,b)) is the location of the first speaker (e.g., the speaker 102*b*). The location 604 (also represented by "R" and coordinates (c,b)) is the location of the second speaker (e.g., the speaker 102*c*). The location 606 (also represented by "O" and coordinates (0,0)) is the first location of the electronic device 104 within the listening area 606. The location 608 (also represented by "O'" and coordinates (d,0)) is the second location of the electronic device 104 within the listening area 606. The exemplary scenario 600 also illustrates distances 610*a*, 610*b*, 610*c*, 610*d*, and 612.

In accordance with an embodiment, the electronic device 104 and/or the control device 102*a* may determine the first absolute distance "m" (such as the distance 610*a*) based on audio output of the first speaker (e.g., the speaker 102*b*) at the location 606 of the electronic device 104. The electronic device 104 and/or the control device 102*a* may determine a second absolute distance "q" (such as the distance 610*c*), based on audio output of the second speaker (e.g., the speaker 102*c*) at the location 606. The second absolute distance "q" (such as the distance 610*c*) may correspond to a distance between the electronic device 104 and the second speaker (e.g., the speaker 102*c*). The first absolute distance "m" (such as the distance 610*a*) and the second absolute distance "q" (such as the distance 610*c*) may be computed from the same location of the electronic device 104, i.e. the location 606.

In some embodiment, the determination of the first absolute distance may be based on a difference between the second time instant and the first time instant. The first time instant (T1) may correspond to a time at which the audio is communicated to the first speaker (e.g., the speaker 102*b*) by the control device 102*a*. Further, the second time instant (T2) may correspond to a time at which the audio output of the first speaker (e.g., the speaker 102*b*) is recorded at a particular location by the electronic device 104. Using the equation (2), the first absolute distance "m" (such as the distance 610*a*) between the electronic device 104 and the first speaker (e.g., the speaker 102*b*) may be determined; given the speed of sound and the difference T2−T1. In an embodiment, the communication of radio signals over the first communication network 214 and/or the second communication network 216 may be nearly instantaneous at the speed of light. Thus, the first timing signal and the second timing signal may be communicated at the speed of light.

In some embodiments, the processor 402 may be configured to determine a plurality of absolute distances between each of the plurality of speakers 102*b* to 102*i*, and the electronic device 104. For example, the determination of the absolute distance between a speaker (e.g., the speaker 102*b*) and the electronic device 104 may be based on a first time difference (that may be referred to as "td1") between the second time instant ("t2") and the time instant (of the plurality of different time instants) associated with recording of the audio sample from the respective speaker (e.g., the speaker 102*b*), as discussed in FIG. 1.

The user 108 holding the electronic device 104 may then move towards the location 608 (i.e. to coordinates (d,0) from the location 606 (from coordinates (0,0)). At this stage, the electronic device 104 (or the control device 102*a*) may re-determine the plurality of absolute distances between each of the plurality of speakers 102*b* to 102*i*, and the electronic device 104, for the new location 608 of the electronic device 104. For example, as shown an absolute distance "n" (such as the distance 610*b*) between the first speaker (e.g., the speaker 102*b*) and the location 608 of the user 108. Further, the electronic device 104 (or the control device 102*a*) may determine another absolute distance "p" (such as the distance 610*d*) between the second speaker (e.g., the speaker 102*c*) and the location 608. Thus, at this stage the distances 610*a*, 610*b*, 610*c*, 610*d* and the locations 602 and 604 of the first speaker (e.g., the speaker 102*b*) and the second speaker (e.g., the speaker 102*c*) may be known. In addition, the initial co-ordinates of the electronic device 104 at location 606 has been considered as (0,0) and the co-ordinates of the location 608 has been considered as (d,0). Thus, the distance 612 (also represented by "d') between the location 606 and the location 608 may be determined using distance formula of co-ordinate geometry, given by equation (12) which is derived as given below:

The distance "m" between the location 606 (also represented by O) and the location 602 (also represented by L) may be given by the following expression:

$$m^2=a^2+b^2 \tag{5}$$

Where, m=distance "m" between the known location 606 (also represented by O) and the known location 602 (also represented by L); and $(a^2+b^2)=(a-0)^2+(b-0)^2$, where $((a-0)^2$ represents one side (LO) of the triangle LOO' and $(b-0)^2$ represents another side LO' of the triangle LOO'.

Similarly, the distance "n" between the location 608 (represented by O') and the location 602 (represented by L) may be given by the following expression:

$$n^2=((a-d)^2+b^2) \tag{6}$$

Further, the distances "q" and "p" may be determined, as per the below-mentioned equations (7) and (8). The distance "q" may correspond to the distance between the location 606 (represented by O) and the location 604 (represented by R). On the other hand, the distance "p" may correspond to the distance between the location 608 (represented by O') and the location 604 (represented by R).

$$q^2=c^2+b^2 \tag{7}$$

$$p^2=((c-d)^2+b^2) \tag{8}$$

Subtracting equation (7) from equation (5), we have, $$c^2-a^2=(q^2-m^2)$$

$$(c+a)(c-a)=(q^2-m^2) \tag{9}$$

Further, subtracting equation (8) from equation (6) and applying other equations (5), (7), and (9), we have, $$(p^2n^2)=q^2-m^2 2d(c-a)$$

$$\text{i.e. } (c-a)=(q2-m^2-p^2+n^2)/2d \tag{10}$$

Similarly, adding equation (8) with equation (6) and applying other equations (5), (7), and (9), we have, $$(p^2+n^2)=q^2-2d^2+m^2-2d(c+a)$$

$$\text{i.e. } (c+a)=(q2+2d^2+m^2-p^2-n^2)/2d \tag{11}$$

Applying equations (10) and (11) in equation 9, we may determine the distance "d" between the location 606 (represented by O) and the location 608 (represented by O') as per the following expression:

$$d^2=\frac{(q2-m^2-p^2+n^2)*(q2+2d^2+m^2-p^2-n^2)}{4(q2-m^2)} \tag{12}$$

In accordance with an embodiment, the electronic device 104 (or the control device 102*a*) may determine the first orientation of the first speaker (e.g., the speaker 102*b*) with respect to the electronic device 104. The determination of the first orientation may be done based on the distance 612 between the two locations 606 and 608 of the electronic device 104, the first absolute distance "m" (such as the distance 610*a*), and/or the second absolute distance "q" (such as the distance 610*c*). In some embodiments, instead of trigonometric based or geometric based computations for absolute distances, for example "n" and "q", such as the distances 610*b* and 610*c*, the use of the constant values to calculate known delay in audio output for each remaining speakers (as described above in FIG. 6) and known number of audio samples, the calculation of the plurality of absolute distances between each of the plurality of speakers 102*b* to 102*i*, and the electronic device 104, may be concurrently computed more efficiently for the location 606 and 608 of the electronic device 104 at once.

The exemplary scenario 600 of FIG. 6 further depicts a first angle 614 (also represented by "K" for the angle LOO' and a second angle 616 (also represented by "L") for the angle ROO'.

When the 3 sides of a triangle are known, the following trignometric equations (13) and (14), may be used to calculate an angle of a triangle, as given below:

$$\cos(K)=(d^2m^2-n^2)/(2dm) \tag{13}$$

$$\cos(L)-(q^2+c^2-b^2)/(2qd) \tag{14}$$

In accordance with an embodiment, the electronic device 104 (or the control device 102*a*) may be configured to determine the first orientation based on the equations (13), and (14). A person with ordinary skill in the art may understand other angles related to the orientation of the first speaker (e.g., the speaker 102*b*) and/or other speakers of the speaker system 102 may be determined based on trigonometric techniques and cosine rules known in the art.

In accordance with an embodiment, the location 602 (also represented by "L") of the first speaker (e.g., the speaker 102*b*), and the location 604 (also represented by "R") of the second speaker (e.g., the speaker 102*c*), may lie on a first plane (shown by dashed line between the locations 602 and 604), which is parallel to a second plane. The second plane may include the locations 606 and 608 of the electronic device 104. A person with ordinary skill in the art may understand that a second orientation of the second speaker (e.g., the speaker 102*c*) with respect to the electronic device 104 may be determined in a manner similar to the determination of the first orientation, as described above.

Figure 7:
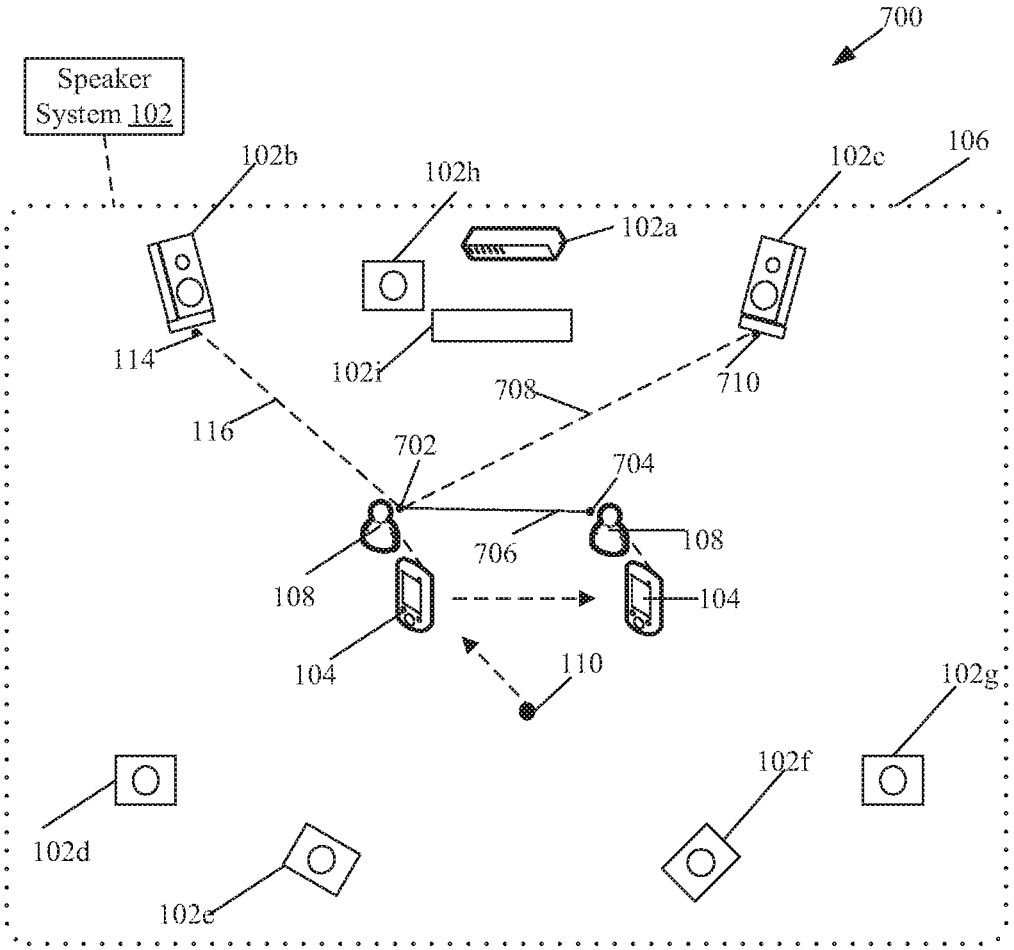
FIG. 7 illustrate an exemplary scenario of a speaker system for speaker position identification with respect to a user based on timing information for enhanced sound adjustment, in accordance with an embodiment of the disclosure.

FIG. 7 illustrates an exemplary scenario of a speaker system, in accordance with an embodiment of the disclosure. With reference to FIG. 7, there is shown an exemplary scenario 700. The FIG. 7 is explained in conjunction with elements from FIGS. 1 to 5, and 6. The exemplary scenario 700 further depicts a first location 702 and a second location 704 of the electronic device 104, a distance 706 between the first location 702 and the second location 704, and a speaker location 710 of the second speaker (such as the speaker 102*c*).

With reference to the exemplary scenario 700, the first listening position 110, may correspond to an acoustic sweet-spot of the speaker system 102. The first listening position 110, may correspond to a location at which audio output of each of the plurality of speakers 102*b* to 102*i* may be focused to, thereby providing an ideal audio experience. The user 108 who holds the electronic device 104 may be present at the first location 702, which may be different from the acoustic sweet-spot of the speaker system 102. In accordance with an embodiment, the electronic device 104 (or the control device 102*a*) may be configured to determine a plurality of absolute distances (e.g., that includes the first distance 116) between the electronic device 104 positioned at the first location 702 and the first speaker (e.g., the speaker 102*b*) positioned at the speaker location 114. The direct distance between the first location 702 of the user 108 (or the electronic device 104) and the speaker location 114 may correspond to the first absolute distance (e.g., the first distance 116). The determination of the first absolute distance (e.g., the first distance 116) and distance 706 between two different locations 702 and 704 of the electronic device 104 by geometrical calculations has been described, for example, in FIG. 6. Based on the first absolute distance (e.g., the first distance 116) and other absolute distances of the plurality of absolute distances, the control device 102*a* may calibrate the plurality of speakers 102*b* to 102*i* for reproduction of the audio. For example, the user 108 may move near to the first speaker (e.g., the speaker 102*b*) as compared to other speakers (such as the speakers 102*c* to 102*i*). Thus, the sound from the plurality of speakers 102*b* to 102*i* reaching the user 108 may not be same. The user 108 may hear more sound output from the nearest speaker, such as the speaker 102*b* in this case. Thus, based on the first absolute distance and the computed other absolute distances of the plurality of absolute distances, the control device 102*a* may calibrate the plurality of speakers 102*b* to 102*i* to reproduce audio at optimum audio mix (e.g. reduced volume level from speaker 102*b*, but higher from 102*c* to maintain balance of surround sound) than before (when the user 108 was located at first listening position 110). Certain other calibrations may be done such a bass-level, and/or one or more audio output properties/settings associated with the first speaker (e.g., the speaker 102*b*) or other speakers 102*c* to 102*i*, may be adjusted.

In accordance with an embodiment, the electronic device 104 (or control device 102*a*) may be configured to further determine a second absolute distance 708 between the electronic device 104 at the first location 702, and the second speaker (e.g., the speaker 102*c*) at the speaker location 710. The determination of the second absolute distance 708 may be performed in a manner similar to the determination of the first absolute distance, as explained in the FIG. 6. Based on the second absolute distance 708, the control device 102*a* may calibrate at least the second speaker (e.g., the speaker 102*c*) for reproduction of the audio. The calibration of the second speaker (e.g., the speaker 102*c*) and other speakers 102*c* to 102*i* may be performed such that an overall audio output from the plurality of speakers 102*b* to 102*i* of the speaker system 102 is balanced. For example, the calibration of the first speaker (e.g., the speaker 102*b*) may lead to an decrease in a volume-level of the first speaker (e.g., the speaker 102*b*). In such a scenario, the second speaker (e.g., the speaker 102*c*) may be calibrated such that an a volume-level or a bass-level of the audio is toned up. This may balance or equalize the overall audio output from the speaker system 102.

Thus, similar to the calibration of the first speaker (e.g., the speaker 102*b*) and the second speaker (e.g., the speaker 102*c*), remaining speakers 102*d* to 102*i* may also be calibrated based on absolute distances from the first location 702 to the respective location of each remaining speakers 102*d* to 102*i* of the plurality of speakers 102*b* to 102*i*. In accordance with an embodiment, the determination of absolute distances from each of the plurality of speakers 102*b* to 102*i* and the electronic device 104, may be done concurrently. Thereafter, the control device 102*a* may be configured to shift the acoustic sweet-spot of the speaker system 102 from the first listening position 110, to the second listening position, such as the current position of the user 108 (or the electronic device 104) based on the concurrent calibration of the plurality of speakers 102*b* to 102*i*. The current position of the user 108, such as the first location 702 corresponds to the second listening position 112 (FIG. 1).

In certain scenarios, the user 108 of the electronic device 104 may move towards to the second location 704. Accordingly, the control device 102*a* may be configured to re-determine another plurality of absolute distances, from the new location, such as the second location 704, of the electronic device 104. For example, a new absolute distance between the electronic device 104 at the second location 704 and the first speaker (e.g., the speaker 102*b*) at the speaker location 11, may be determined. Similarly, a new absolute distance between the electronic device 104 at the second location 704 and the second speaker (e.g., the speaker 102*c*) at the speaker location 706, may be determined. Based on the re-determination of the other plurality of absolute distances, from the new location, such as the second location 704, the control device 102*a* may re-calibrate the plurality of speakers 102*b* to 102*i* simultaneously for reproduction of the audio. Thus, the control device 102*a* may be configured to re-shift the acoustic sweet-spot of the speaker system 102 from the second listening position, such as the first location 702 to the current position of the user 108, such as the second location 704.

In accordance with an embodiment, in addition to the absolute distances, the control device 102*a* (or the electronic device 104) may be configured to determine an orientation, such as the first orientation of the first speaker (e.g., the speaker 102*b*) with respect to the electronic device 104. The first orientation may be determined based on the distance between two locations 702 and 704 of the electronic device 104, and the first absolute distance (such as the distance 116), by coordinate geometry equations or by use of constant values, as described, for example, in the FIG. 6. The calibration of the first speaker (e.g., the speaker 102*b*) may direct the audio output of the speaker system 102 towards a direction of the first orientation for enhanced user experience. In accordance with an exemplary aspect of the disclosure, instead of the control device 102*a*, the plurality of the absolute distances and the orientation may be determined by the electronic device 104, as described in FIGS. 1, 9, and 10.

Figure 8:
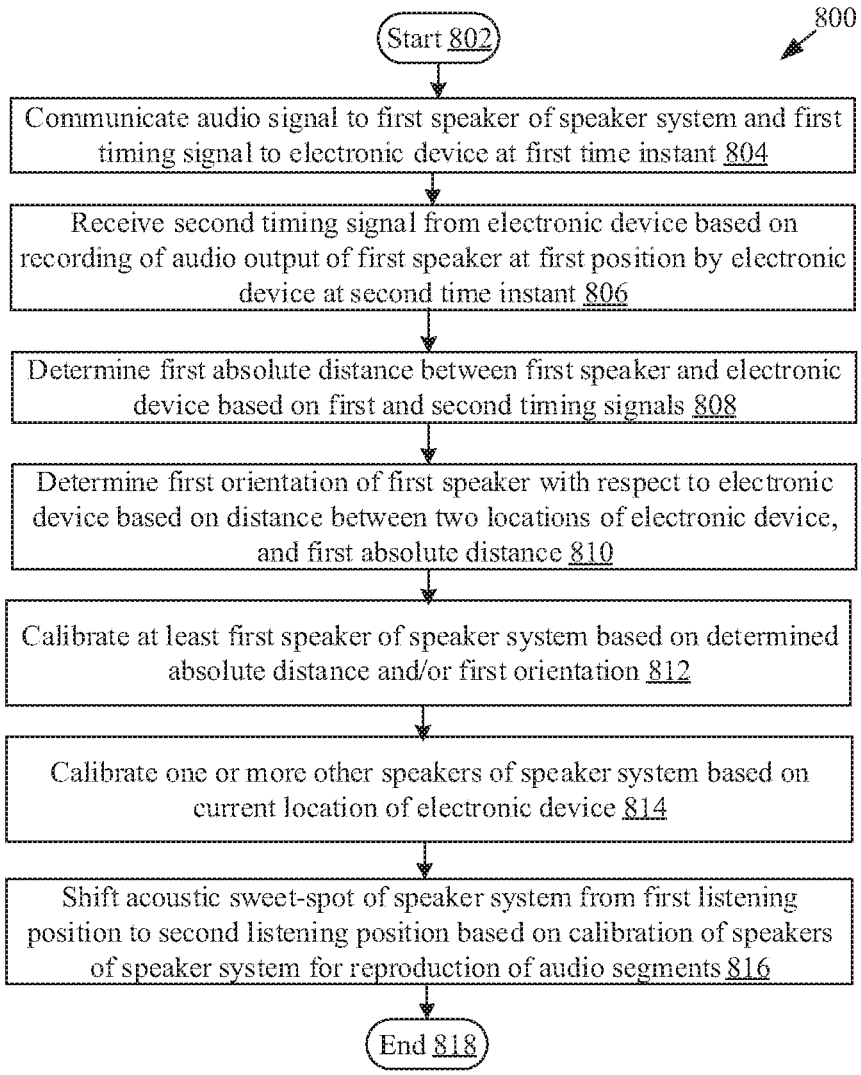
FIG. 8 is a first flow chart that illustrates a method for a speaker system for speaker position identification with respect to a user based on timing information for enhanced sound adjustment, in accordance with an embodiment of the disclosure.

FIG. 8 depicts a flow chart that illustrates a method for a speaker system, in accordance with an embodiment of the disclosure. With reference to FIG. 8, there is shown a flow chart 800 implemented in the control device 102*a*. The flow chart 800 is described in conjunction with FIG. 1. The method starts at step 802 and proceeds to step 804.

At 804, an audio signal may be communicated to the first speaker (e.g., the speaker 102*b*) and the first timing signal may be communicated to the electronic device 104 at the first time instant. The control device 102*a* may be configured to communicate the audio signal to the first speaker (e.g., the speaker 102*b*) at the first time instant and the first timing signal to the electronic device 104. In accordance with an embodiment, the first timing signal may indicate the first time instant at which the audio signal of multimedia AV content is communicated to the first speaker (e.g., the speaker 102*b*). The communication of the audio signal to the first speaker (e.g., the speaker 102*b*) may be via the first communication network 214. The communication of the first timing signal to the electronic device 104 may be via the second communication network 216.

At 806, a second timing signal may be received from the electronic device 104. The control device 102*a* may be configured to receive the second timing signal from the electronic device 104. The second timing signal may indicate the second time instant at which the electronic device 104 records the audio output from the first speaker (e.g., the speaker 102*b*), at a first position (such as the first location 702 (FIG. 7) or the second listening position 112 (FIG. 1)) of the electronic device 104.

At 808, a first absolute distance between the first speaker (e.g., the speaker 102*b*) and the electronic device 104 may be determined. The control device 102*a* may be configured to determine the first absolute distance based on the first timing signal and the second timing signal. In accordance with an embodiment, the determination of the first absolute distance may be based on a difference between the second time instant provided in the second timing signal and the first time instant provided in the first timing signal.

At 810, a first orientation of the first speaker (e.g., the speaker 102*b*) with respect to the electronic device 104 may be determined. The control device 102*a* may be configured to determine the first orientation based on a distance between two different locations of the electronic device 104, and the first absolute distance. The determination of the first orientation may be further based on the second absolute distance between the second speaker (e.g., the speaker 102*c*) and the electronic device 104. The determination of the second absolute distance and the first orientation have been explained, for example, in the FIG. 6.

At 812, at least the first speaker (e.g., the speaker 102*b*) may be calibrated for reproduction of the audio. The control device 102*a* may be configured to calibrate the first speaker (e.g., the speaker 102*b*) based on the first absolute distance and/or the first orientation.

At 814, the plurality of speakers 102*b* to 102*i* of the speaker system 102 may be calibrated for reproduction of the one or more audio segments of the audio. The control device 102*a* may be configured to calibrate the plurality of speakers 102*b* to 102*i* based on the calibration of the first speaker (e.g., the speaker 102*b*). In accordance with an embodiment, the control device 102*a* may be further configured to re-calibrate the plurality of speakers 102*b* to 102*i* of the speaker system 102 for the reproduction of the audio, based on the current position, such as the second location 704, of the user 108 associated with the electronic device 104.

At 816, the acoustic sweet-spot of the speaker system 102 may be shifted from a first listening position to a second listening position. The control device 102*a* may be configured to shift the acoustic sweet-spot of the speaker system 102 based on the calibration of the plurality of speakers 102*b* to 102*i* for reproduction of the one or more audio segments. In accordance with an embodiment, the acoustic sweet-spot may correspond to a location, such as the first listening position 110, in the listening area 106 at which the audio output of the plurality of speakers 102*b* to 102*i* is focused. The acoustic sweet-spot may correspond to an ideal listening location within the listening area 106 at which an ideal audio output from the plurality of speakers 102*b* to 102*i* may be experience by the user 108. The acoustic sweet-spot may be shifted from the first listening position 110, (such as, an initial acoustic sweet-spot) to the second listening position 112 (such as, a current location of the electronic device 104 or the user 10). Further, the shifting of the acoustic sweet-spot of the speaker system 102 have been explained, for example, in FIGS. 1 and 7. Control passes to end 818.

Figure 9:
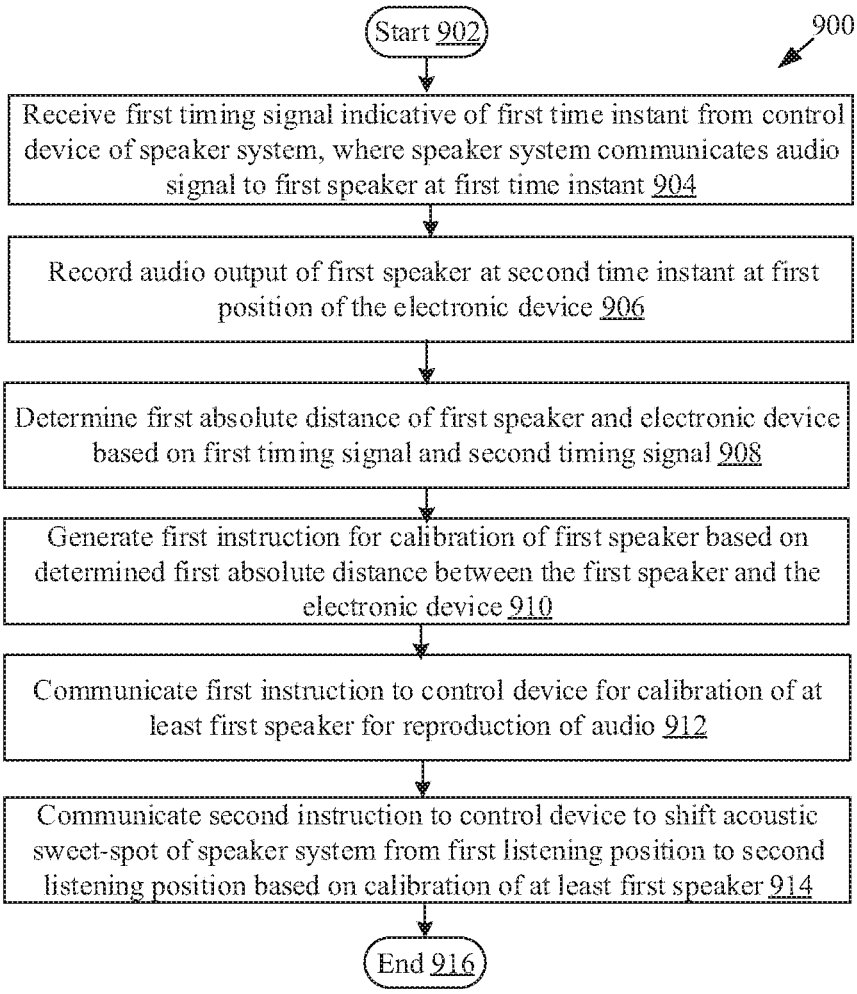
FIG. 9 is a second flow chart that illustrates a method for a speaker system for speaker position identification with respect to a user based on timing information for enhanced sound adjustment, in accordance with an embodiment of the disclosure.

FIG. 9 depicts a flow chart that illustrates a method for a speaker system, in accordance with an embodiment of the disclosure. With reference to FIG. 9, there is shown a flow chart 900 implemented in the electronic device 104. The flow chart 900 is described in conjunction with elements from FIGS. 1 to 7. The method starts at 902 and proceeds to 904.

At 904, a first timing signal indicative of a first time instant may be received from the control device 102*a*. The electronic device 104 may be configured to receive the first timing signal from the control device 102*a*, via the second communication network 216. The first time instant may correspond to a timestamp at which the control device 102*a* communicates the audio signal to the first speaker (e.g., the speaker 102*b*) for reproduction of the audio.

At 906, the audio output of the first speaker (e.g., the speaker 102*b*) may be recorded. The electronic device 104 may be configured to record the audio output of the first speaker (e.g., the speaker 102*b*) at the second time instant, at a first position (such as the second listening position 112 or the first location 702) of the electronic device 104.

At 908, the first absolute distance between the first speaker (e.g., the speaker 102*b*) and the electronic device 104 may be determined. The electronic device 104 may be configured to determine the first absolute distance based on the first timing signal and the second timing signal. The determination of the first absolute distance may be based on a difference between the second time instant provided in the second timing signal, and the first time instant provided in the first timing signal. The determination of the first absolute distance has been explained, for example, in FIG. 6. In accordance with an embodiment, the electronic device 104 may be further configured to determine the first orientation of the first speaker (e.g., the speaker 102*b*) with respect to the electronic device 104. The first orientation may be determined based on distance between two different locations of the electronic device 104 and the first absolute distance. The determination of the first orientation has been explained, for example, in FIGS. 6 and 7.

At 910, a first instruction for calibration of at least the first speaker (e.g., the speaker 102*b*) may be generated. The electronic device 104 may be configured to generate the first instruction based at least on the determined first absolute distance and/or the first orientation. The generation of the first instruction may be further based on a user-input, received from the user 108 via the application interface of the electronic device 104, for the calibration of at least the first speaker (e.g., the speaker 102*b*). In accordance with an embodiment, the first instruction may also include information or instructions associated with re-calibration of the plurality of speakers 102*b* to 102*i* of the speaker system 102 for the reproduction of the audio, based on the current position of the user 108 associated with the electronic device 104.

At 912, the generated first instruction may be communicated to the control device 102*a*. The electronic device 104 may be configured to communicate the generated first instruction to the electronic device 104, via the second communication network 216.

At 914, a second instruction to shift the acoustic sweet-spot of the speaker system 102 may be communicated to the control device 102*a*. The electronic device 104 may be configured to communicate the second instruction to the control device 102*a*, via the second communication network 216. The second instruction may include instructions associated with shifting of the acoustic sweet-spot of the speaker system 102 from the first listening position 110, (an initial acoustic sweet-spot) to the second listening position 112 (e.g., a current/initial position of the electronic device 104). Further, the second instruction may include instructions for calibration of the plurality of speakers 102*b* to 102*i* for the reproduction of the one or more audio segments of the audio. The shifting of the acoustic sweet-spot of the speaker system 102 may be based on this calibration of the plurality speakers 102*b* to 102*i*. In accordance with an embodiment, the generation of the second instruction may be initiated based on a user-input, received from the user 108 via the application interface of the electronic device 104, for the shifting of the acoustic sweet-spot. Control passes to end 916.

Figure 10:
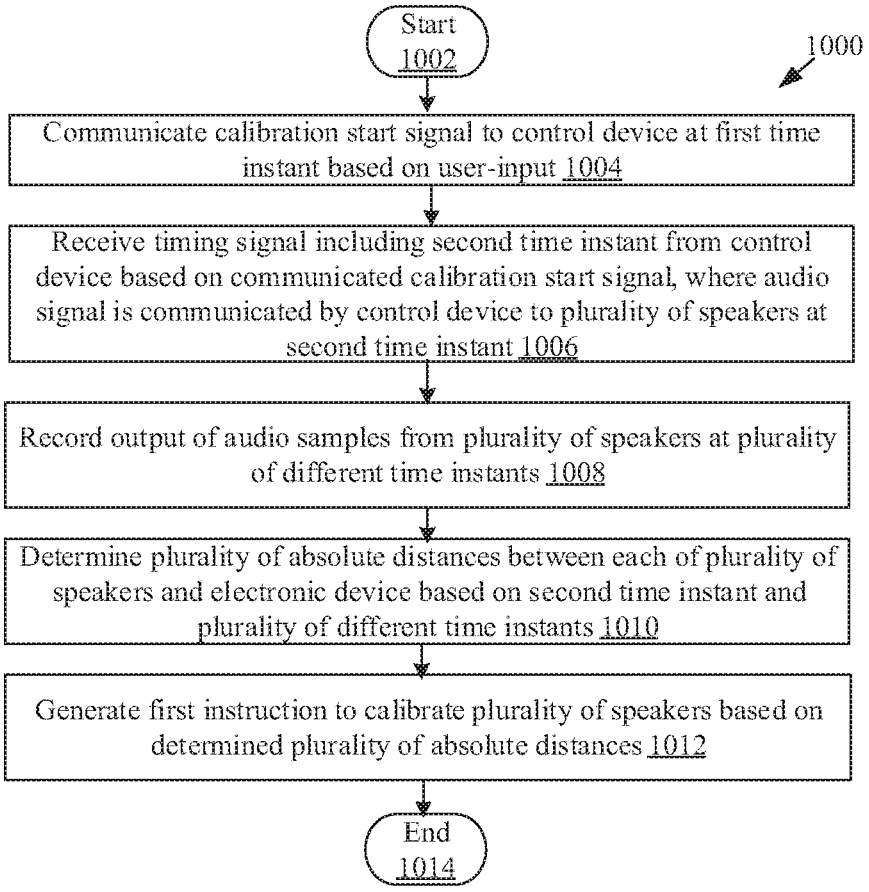
FIG. 10 is a third flow chart that illustrates a method implemented in the electronic device of FIG. 4 for speaker position identification with respect to a user based on timing information for enhanced sound adjustment in a speaker system, in accordance with an embodiment of the disclosure.

FIG. 10 depicts a flow chart that illustrates a method for a speaker system, in accordance with an embodiment of the disclosure. With reference to FIG. 10, there is shown a flow chart 1000 implemented in the electronic device 104. The flow chart 1000 is described in conjunction with elements from FIGS. 1 to 7. The method starts at 1002 and proceeds to 1004.

At 1004, a calibration start signal is communicated to the control device 104 based on user input (i.e. a user initiated auto-calibration process as discussed n FIG. 1). In accordance with an embodiment, the electronic device 104 may be configured to communicate the calibration start signal to the control device 102*a*. The calibration start signal may include instructions that may direct the control device 102*a* to initiate calibration of the plurality of speakers 102*b* to 102*i* of the speaker system 102. The calibration start signal may be generated in response to reception of a user-input by the electronic device 104, for calibration of the speaker system 102. On reception of this user-input (for instance, at a first time instant, say time instant "t1"), the electronic device 104 may be configured to generate a timestamp. The electronic device 104 may use an inbuilt GPS module or the timer circuit 414 to generate the timestamp at this first time instant based on timing information provided by the GPS module or the timer circuit 414. Thereafter, the electronic device 104 may store the timestamp in the memory 404.

At step 1006, a timing signal including information related to a second time instant (say, time instant "t2") may be received from the control device 102*a*. In accordance with an embodiment, the electronic device 104 may be configured to receive the timing signal from the control device 102*a* in response to the receipt of the calibration start signal at the control device 102*a* from the electronic device 104. The second time instant may correspond to a time at which the control device 102*a* may communicate (for example, a broadcast) an audio signal, comprising "X" number of known audio samples, to all of the plurality of speakers 102*b* to 102*i*. That is, the audio signals may be communicated to each of the plurality of speakers 102*b* to 102*i* simultaneously by the control device 102*a* at the second time instant "t2". In accordance with an embodiment, the electronic device 104 may store the received information related to the second time instant in the memory 404.

At 1008, output of audio samples from the plurality of speakers 102*b* to 102*i* may be recorded by the electronic device 104 at plurality of different time instants. In accordance with an embodiment, the electronic device 104 may record the output of the audio samples from the plurality of speakers 102*b* to 102*i*, when each of the respective speakers starts to audio output. Once the electronic device 104 detects a start of audio sample output from a particular speaker (e.g., the speaker 102*b*), the electronic device 104 determines a current time instant (e.g., a time instant, ts1). Similarly, upon detection of the start of audio sample output from the other speakers (e.g., the speakers 102*c* to 102*i*), the electronic device 104 records corresponding time instants (say, time instants ts2 to ts8). Thereafter, the electronic device 104 may store information indicating the different time instants (e.g., the time instants ts1 to ts8) in the memory 404.

At 1010, a plurality of absolute distances between each of the plurality of speakers 102*b* to 102*i* and the electronic device 104 is determined. In accordance with an embodiment, the plurality of absolute distances may be determined based at least on the second time instant (e.g., the time instant "t2) and the plurality of different time instants (e.g., the time instants ts1 to ts8). For instance, the absolute distance between the electronic device 104 and the speaker 102*b* may be determined based on a difference between the second time instant ("t2") and the time instant ("ts2") associated with the speaker 102*b*, and so on.

The determination of the absolute distance between a speaker (e.g., the speaker 102*b*) and the electronic device 104 may be further based on a first time difference (that may be referred to as "td1") between the second time instant ("t2") and the time instant (of the plurality of different time instants "ts1 to ts8") associated with recording of the audio sample from the respective speaker (e.g., the speaker 102*b*). The value of the first time difference ("td1") may be used to calculate the distance of the speaker 102*b* to the user 108 (that holds the electronic device 104). The determination of the absolute distance is discussed in details in FIG. 1. The location of the user 108 may be considered same as the location of the electronic device 104 as the user 108 holds the electronic device 104, such as a smartphone. Similarly, for other speakers of the speaker system 102, the plurality of absolute distances between each of the plurality of speakers

102*b* to 102*i*, and the electronic device 104, may be determined. The determination of the plurality of absolute distances may be performed in a manner similar to the determination of the first absolute distance described in conjunction with FIG. 6.

Further, in accordance with an embodiment, an orientation of each of the plurality of speakers 102*b* to 102*i*, with respect to the electronic device 104, may be determined based at least on the determined plurality of absolute distances. For example, at a first location of the user 108 of the electronic device 104, the plurality of absolute distances between the electronic device 104 and each of the plurality of speakers 102*b* to 102*i* may be determined, as described above. Thereafter, a second plurality of absolute distances between the electronic device 104 and each of the plurality of speakers 102*b* to 102*i* may be determined at a second location of the user 108. The electronic device 104 may determine the orientation of each of the plurality of speakers 102*b* to 102*i* with respect to the electronic device 104 based at least on the pair of pluralities of absolute distances. Further details related to determination of the orientation of a speaker with respect to the electronic device 104 has been explained in conjunction with FIGS. 6 and 7

At 1012, a first instruction to calibrate the plurality of speakers 102*b* to 102*i* may be generated based on the determined plurality of absolute distances. In accordance with an embodiment, the electronic device 104 may be configured to generate the first instruction. The first instruction may include details related to the calibration of each of the plurality of speakers 102*b* to 102*i* of the speaker system 102. Thereafter, the electronic device 104 may communicate the first instruction to the control device 102*a*. The control passes to the end 1014.

In accordance with an embodiment of the disclosure, a speaker system (e.g., the speaker system 102, FIG. 1) including a plurality of speakers 102*b* to 102*i* and at least one processor (e.g., the processor 202 of the control device 102*a*, FIG. 2) is disclosed. The processor 202 (FIG. 2) may be communicatively coupled to the plurality of speakers 102*b* to 102*i* and an electronic device (e.g., the electronic device 104, FIG. 1), via one or more communication networks (e.g., the first communication network 214 and the second communication network 216, respectively; FIG. 2). Further, the processor 202 may communicate audio signal to a first speaker (e.g., the speaker 102*b*, FIG. 1) of the plurality of speakers and a first timing signal to the electronic device 104 at a first time instant. In accordance with an embodiment, the first timing signal may indicate the first time instant. Thereafter, the processor 202 may receive a second timing signal indicative of a second time instant from the electronic device 104. In accordance with an embodiment, the second time instant may correspond to a time at which the electronic device 104 may record the audio output of the first speaker (e.g., the speaker 102*b*). In accordance with an embodiment, the processor 202 may be configured to determine a first absolute distance between the first speaker (e.g., the speaker 102*b*) and the electronic device 104, based on the first timing signal and the second timing signal. The determination of the first absolute distance may be based on a difference between the second time instant and the first time instant. In accordance with an embodiment, the processor 202 may be further configured to determine a first orientation of the first speaker (e.g., the speaker 102*b*) with respect to the electronic device 104, based on a distance between two locations of the electronic device 104 and the first absolute distance. Thereafter, the processor 202 may calibrate at least the first speaker (e.g., the speaker 102*b*) for reproduction of the audio, based on the first absolute distance and/or the first orientation.

In accordance with an embodiment, the processor 202 may be further configured to re-calibrate the plurality of speakers of the speaker system 102 for reproduction of the audio based on the current position of a user (e.g., the user 108, FIG. 1) of the electronic device 104. In accordance with an embodiment, the processor 202 may also be configured to shift an acoustic sweet-spot of the speaker system 102 from a first listening position (e.g., a location 702, FIG. 7B) to a second listening position (e.g., a location 706*b*, FIG. 7B). The acoustic sweet-spot of the speaker system 102 may correspond to a location at which the plurality of speaker reproduce an optimum audio output. The first listening position (e.g., the location 702) may correspond to an initial location of the acoustic sweet-spot, while the second listening position (e.g., the location 706*a*) may correspond to a current/initial location of the electronic device 104 (e.g., the location 706*a*). In accordance with an embodiment, the shifting of the acoustic sweet-spot may be based on calibration of the plurality of speakers for reproduction of one or more audio segments of the audio.

There are certain challenges in the art for configuration and calibration of speaker systems. The methods and systems of the disclosed embodiments may help in the calibration of speakers of the speaker system based on determination of absolute distance and/or orientation of a speaker of the speak system from an electronic device of a user. Further, the other speakers may be re-calibrated for reproduction of audio based on a current location of the user of the electronic device. The disclosed embodiments also lead to an enhanced audio experience for the user based on shifting of an acoustic sweet-spot of the speaker system from an initial position (a pre-defined acoustic sweet-spot) to the current location of the user. The shifting of the acoustic sweet-spot may be based on the calibration of the speakers of the speaker system for reproduction of one or more audio segments of the audio.

Various embodiments of the disclosure may provide a non-transitory computer readable medium and/or storage medium having stored thereon, a machine code and/or a computer program having at least one code section executable by a machine and/or a computer for a speaker system. The at least one code section may cause the machine and/or computer to perform the steps that comprise the reception of a first timing signal from a control device of the speaker system. The first timing signal indicates a first time instant at which an audio signal is communicated, by the control device, to a first speaker of a plurality of speakers of the speaker system. Thereafter, an output of the audio signal is recorded from the first speaker at a second time instant. Further, an absolute distance between the first speaker and the electronic device associated with a user is determined, based on said first and second time instants. Thereafter, a first instruction to calibrate at least the first speaker is generated, based on the determined absolute distance, and communicated to the control device for the calibration of the first speaker.

The present disclosure may be realized in hardware, or a combination of hardware and software. The present disclosure may be realized in a centralized fashion, in at least one computer system, or in a distributed fashion, where different elements may be spread across several interconnected computer systems. A computer system or other apparatus adapted to carry out the methods described herein may be suited. A combination of hardware and software may be a general-purpose computer system with a computer program that, when loaded and executed, may control the computer system such that it carries out the methods described herein. The present disclosure may be realized in hardware that comprises a portion of an integrated circuit that also performs other functions.

The present disclosure may also be embedded in a computer program product, which comprises all the features that enable the implementation of the methods described herein, and which, when loaded in a computer system, is able to carry out these methods. Computer program, in the present context, means any expression, in any language, code or notation, of a set of instructions intended to cause a system with an information processing capability to perform a particular function either directly, or after either or both of the following: a) conversion to another language, code or notation; b) reproduction in a different material form.

While the present disclosure has been described with reference to certain embodiments, it will be understood by those skilled in the art that various changes may be made and equivalents may be substituted without deviation from the scope of the present disclosure. In addition, many modifications may be made to adapt a particular situation or material to the teachings of the present disclosure without deviation from its scope. Therefore, it is intended that the present disclosure not be limited to the particular embodiment disclosed, but that the present disclosure will include all embodiments falling within the scope of the appended claims.

What is claimed is:

1. A speaker system, comprising:

a plurality of speakers; and at least one processor communicatively coupled to said plurality of speakers and an electronic device, wherein said electronic device is associated with a user, wherein said at least one processor is configured to:

transmit an audio signal to a first speaker of said plurality of speakers at a first time instance, and a first timing signal to said electronic device, wherein said first timing signal is indicative of said first time instance;

receive a second timing signal from said electronic device, wherein said second timing signal is indicative of a second time instance at which an output of said audio signal from said first speaker is recorded by said electronic device at a first location of said electronic device;

determine a first absolute distance, between said first speaker and said electronic device, based on said first timing signal and said second timing signal;

calibrate at least said first speaker based on said first absolute distance; and reproduce audio based on said calibration of at least said first speaker.

2. The speaker system according to claim 1, wherein said at least one processor is further configured to generate said first timing signal based on at least one of a Global Positioning System (GPS)-based circuit, a radio frequency-based circuit, or a timer circuit, and wherein said speaker system further comprises said at least one of Global Positioning System (GPS)-based circuit, radio frequency-based circuit, or timer circuit.

3. The speaker system according to claim 1, wherein said at least one processor is further configured to determine said first absolute distance based on a difference between said second time instance and said first time instance.

4. The speaker system according to claim 1, wherein said at least one processor is further configured to determine a second absolute distance between a second speaker of said plurality of speakers and said electronic device at said first location of said electronic device, wherein an output of said audio signal from said second speaker is recorded by said electronic device at said first location.

5. The speaker system according to claim 4, wherein said at least one processor is further configured to determine, a third absolute distance from said first speaker to said electronic device and a fourth absolute distance from said second speaker to said electronic device, at a second location of said electronic device at which said output of said audio signal from said first speaker and said second speaker is recorded by said electronic device.

6. The speaker system according to claim 5, wherein said first location of said electronic device and said second location of said electronic device are in a first plane that is parallel to a second plane, wherein said first speaker and said second speaker are in said second plane.

7. The speaker system of claim 5, wherein said at least one processor is further configured to determine a first orientation of said first speaker with respect to said electronic device, based on a distance between said first location of said electronic device and said second location of said electronic device, and said first absolute distance of said first speaker from said electronic device.

8. The speaker system of claim 7, wherein said at least one processor is further configured to calibrate at least said first speaker in a direction of said first orientation.

9. The speaker system according to claim 1, wherein said at least one processor is further configured to:

re-calibrate said plurality of speakers based on a current listening position of said user associated with said electronic device; and reproduce said audio based on said re-calibration of said plurality of speakers.

10. The speaker system according to claim 1, wherein said at least one processor is further configured to:

shift an acoustic sweet-spot of said speaker system from a first listening position to a second listening position, based on calibration of said plurality of speakers, wherein said second listening position corresponds to said first location; and reproduce a plurality of audio segments based on said shift and said calibration of said plurality of speakers.

11. An electronic device for a speaker system, comprising:

at least one processor configured to:

receive a first timing signal from a control device of said speaker system, wherein said first timing signal indicates a first time instance at which an audio signal is communicated, by said control device, to a first speaker of a plurality of speakers of said speaker system;

record an output of said audio signal from said first speaker at a second time instance;

determine an absolute distance between said first speaker and said electronic device, based on said first time instance and said second time instance; and generate, a first instruction to calibrate at least said first speaker of said plurality of speakers, based on said absolute distance.

12. The electronic device according to claim 11, wherein said at least one processor is further configured to determine said absolute distance based on a difference between said second time instance and said first time instance.

13. The electronic device according to claim 11, wherein said at least one processor is further configured to communicate said first instruction, to said control device for said calibration of said at least said first speaker of said plurality of speakers.

14. The electronic device according to claim 11, wherein said at least one processor is further configured to communicate a second instruction, to said control device of said speaker system, to shift an acoustic sweet-spot of said speaker system from a first listening position to a second listening position, based on said calibration of said plurality of speakers.

15. The electronic device according to claim 11, wherein said at least one processor is further configured to determine a first orientation of said first speaker with respect to said electronic device, based on a distance between two different locations of said electronic device, and said absolute distance of said first speaker from said electronic device.

16. A method for a speaker system, comprising:

transmitting, by at least one processor of a control device of said speaker system, an audio signal to a first speaker of a plurality of speakers of said speaker system at a first time instance and a first timing signal to an electronic device, wherein said first timing signal is indicative of said first time instance;

receiving, by said at least one processor, a second timing signal from said electronic device, wherein said second timing signal is indicative of a second time instance at which an output of said audio signal from said first speaker is recorded by said electronic device at a first location of said electronic device;

determining, by said at least one processor, a first absolute distance between said first speaker and said electronic device, based on said first timing signal and said second timing signal;

calibrating, by said at least one processor, at least said first speaker based on said first absolute distance; and reproducing audio based on said calibration of at least said first speaker.

17. The method according to claim 16, further comprising determining said first absolute distance based on a difference between said second time instance and said first time instance.

18. The method according to claim 16, further comprising shifting, by said at least one processor, an acoustic sweet-spot of said speaker system from a first listening position to a second listening position, based on said calibration of said plurality of speakers.

19. A method for a speaker system, comprising:

receiving, by at least one processor of an electronic device, a first timing signal from a control device of said speaker system, wherein said first timing signal indicates a first time instance at which an audio signal is communicated, by said control device, to a first speaker of a plurality of speakers of said speaker system;

recording, by said electronic device associated with an user, an output of said audio signal from said first speaker, at a second time instance;

determining, by said electronic device, an absolute distance between said first speaker and said electronic device, based on said first time instance and said second time instance; and generating, by said electronic device, a first instruction to calibrate at least said first speaker of said plurality of speakers, based on said absolute distance.

20. The method according to claim 19, further comprising communicating, by said at least one processor, said first instruction, to said control device for said calibration of said at least said first speaker of said plurality of speakers.

21. An electronic device for a speaker system, comprising:

at least one processor configured to:

communicate, at a first time instance, a calibration start signal to a control device that is communicatively coupled to a plurality of speakers of said speaker system;

store, said first time instance in a memory of the electronic device;

receive a timing signal from said control device of said speaker system based on said communicated calibration start signal, wherein said timing signal indicates a second time instance at which an audio signal is communicated, by said control device, to said plurality of speakers of said speaker system;

record an output of a plurality of audio samples included in said audio signal from said plurality of speakers at a plurality of different time instances;

determine a plurality of absolute distances between each of said plurality of speakers and said electronic device, based on said second time instance and said plurality of different time instances; and generate a first instruction to calibrate said plurality of speakers, based on said plurality of absolute distances.

* * * * *